US008534301B2

(12) United States Patent
Nottingham et al.

(10) Patent No.: US 8,534,301 B2
(45) Date of Patent: Sep. 17, 2013

(54) STEAM MOP

(75) Inventors: John R. Nottingham, Bratenhal, OH (US); Brian V. Sokol, Vermilion, OH (US); John W. Spirk, Gates Mills, OH (US); Douglas E. Whitner, Chagrin Falls, OH (US); Michael O'Toole, Parma, OH (US); Marc Vitantonio, South Russell, OH (US); Michael Schiavoni, Euclid, OH (US); Robert Soreo, Cleveland Hts., OH (US); Brian Catlett, Shaker Heights, OH (US)

(73) Assignee: Innovation Direct LLC, Cleveland, OH (US)

( * ) Notice: Subject to any disclaimer, the term of this patent is extended or adjusted under 35 U.S.C. 154(b) by 1154 days.

(21) Appl. No.: 12/468,573

(22) Filed: May 19, 2009

(65) Prior Publication Data

US 2010/0126533 A1 May 27, 2010

Related U.S. Application Data

(60) Provisional application No. 61/057,936, filed on Jun. 2, 2008.

(51) Int. Cl.
*A47L 11/40* (2006.01)

(52) U.S. Cl.
USPC ..... 134/105

(58) Field of Classification Search
USPC ..... 134/105
See application file for complete search history.

(56) References Cited

U.S. PATENT DOCUMENTS

| | | | |
|---|---|---|---|
| 1,554,875 | A | 9/1925 | Miles |
| 1,616,767 | A | 2/1927 | Stevens |
| 1,720,165 | A | 7/1929 | Bloom |
| 1,726,399 | A | 8/1929 | Lipton |
| 2,053,282 | A | 9/1936 | Gewalt |
| 2,637,062 | A | 5/1953 | Sutton |
| D191,300 | S | 9/1961 | Anderson |
| 3,108,312 | A | 10/1963 | Ballantyne |
| 3,344,453 | A | 10/1967 | Price |
| 3,796,186 | A | 3/1974 | Bounds |

(Continued)

FOREIGN PATENT DOCUMENTS

| | | |
|---|---|---|
| CH | 429211 | 1/1967 |
| CN | 1368032 | 9/2002 |

(Continued)

OTHER PUBLICATIONS

International Search Report dated Jul. 29, 2009.

(Continued)

*Primary Examiner* — Michael Kornakov
*Assistant Examiner* — Jason Riggleman
(74) *Attorney, Agent, or Firm* — Fay Sharpe LLP

(57) ABSTRACT

A steam mop that includes a handle, an extension member, a base mount, a steam generator, and a mop head. The steam generator includes a body that at least partially contains a fluid tank, fluid pump and a heating element used to at least partially vaporize fluid. The body of the steam generator is designed to be releasably connected to the base mount such that the steam generator can be used as a steam producing device for the steam mop or can be disconnected from the base mount and be used as a stand alone steam producing device.

36 Claims, 10 Drawing Sheets

(56) References Cited

U.S. PATENT DOCUMENTS

| | | | | |
|---|---|---|---|---|
| 4,073,030 | A | 2/1978 | Albishausen | |
| 4,074,387 | A | 2/1978 | Arato | |
| 4,105,142 | A | 8/1978 | Morris | |
| 4,312,598 | A | 1/1982 | Vagner | |
| 4,327,459 | A | 5/1982 | Gilbert | |
| 4,433,451 | A | 2/1984 | Parisi | |
| 4,541,132 | A | 9/1985 | Long | |
| 4,549,243 | A | 10/1985 | Owen | |
| 4,552,162 | A | 11/1985 | Finger | |
| 4,561,037 | A | 12/1985 | MacLaine | |
| 4,584,736 | A | 4/1986 | Gremminger | |
| 4,649,895 | A | 3/1987 | Yasuki | |
| 4,663,639 | A | 5/1987 | Owen | |
| 4,728,843 | A | 3/1988 | Mishiro | |
| 4,833,298 | A * | 5/1989 | Wilkins | 392/399 |
| 4,905,712 | A | 3/1990 | Bowlin | |
| 4,951,346 | A | 8/1990 | Salmon | |
| 4,965,977 | A | 10/1990 | White | |
| D313,879 | S | 1/1991 | Ito | |
| RE33,926 | E | 5/1992 | Waldhauser | |
| 5,121,884 | A | 6/1992 | Noakes | |
| 5,133,107 | A | 7/1992 | MacDonald | |
| 5,165,866 | A | 11/1992 | Kato | |
| 5,184,778 | A | 2/1993 | Noakes | |
| 5,222,664 | A | 6/1993 | Noakes | |
| 5,251,416 | A | 10/1993 | White | |
| 5,330,081 | A | 7/1994 | Davenport | |
| 5,341,541 | A | 8/1994 | Sham | |
| 5,386,612 | A | 2/1995 | Sham | |
| 5,502,872 | A | 4/1996 | Chae et al. | |
| D372,570 | S | 8/1996 | Dokos | |
| 5,570,820 | A | 11/1996 | Amoraal | |
| 5,613,271 | A | 3/1997 | Thomas | |
| 5,626,936 | A | 5/1997 | Alderman | |
| D388,705 | S | 1/1998 | Miller et al. | |
| 5,755,578 | A | 5/1998 | Contant | |
| 5,810,265 | A | 9/1998 | Cornelius | |
| 5,819,364 | A * | 10/1998 | Sham | 15/320 |
| 5,895,418 | A | 4/1999 | Saringer | |
| 5,907,879 | A | 6/1999 | Downey | |
| 5,920,952 | A | 7/1999 | Baldacci | |
| 5,927,618 | A | 7/1999 | Jefferies | |
| 5,932,011 | A | 8/1999 | Noakes | |
| 5,932,940 | A | 8/1999 | Epstein | |
| 5,933,913 | A | 8/1999 | Wright | |
| 5,968,281 | A | 10/1999 | Wright | |
| 5,970,572 | A | 10/1999 | Thomas | |
| 5,983,448 | A | 11/1999 | Wright | |
| 6,000,088 | A | 12/1999 | Wright | |
| 6,031,969 | A | 2/2000 | Burr | |
| 6,065,182 | A | 5/2000 | Wright | |
| 6,079,634 | A | 6/2000 | Noakes | |
| D428,226 | S | 7/2000 | Kunkler | |
| 6,101,671 | A | 8/2000 | Wright | |
| 6,112,367 | A | 9/2000 | Burr | |
| 6,138,671 | A | 10/2000 | Noakes | |
| D433,546 | S | 11/2000 | Milanese | |
| 6,148,144 | A | 11/2000 | Milanese | |
| 6,289,551 | B1 | 9/2001 | Basile | |
| 6,311,903 | B1 | 11/2001 | Gaw | |
| 6,314,972 | B1 | 11/2001 | Sin | |
| 6,318,647 | B1 | 11/2001 | Gaw | |
| 6,326,097 | B1 | 12/2001 | Hockaday | |
| 6,328,543 | B1 | 12/2001 | Benecke | |
| 6,376,444 | B1 | 4/2002 | Hortel | |
| 6,392,313 | B1 | 5/2002 | Epstein | |
| D458,427 | S | 6/2002 | Kunkler | |
| 6,453,506 | B1 | 9/2002 | Sumner | |
| 6,490,753 | B1 * | 12/2002 | Chen | 15/320 |
| 6,517,648 | B1 | 2/2003 | Bouchette | |
| 6,541,149 | B1 | 4/2003 | Maynard | |
| 6,571,421 | B1 | 6/2003 | Sham | |
| 6,584,990 | B2 | 7/2003 | Shaw | |
| 6,589,294 | B2 | 7/2003 | Hortel | |
| D482,829 | S | 11/2003 | Vosbikian | |
| D486,279 | S | 2/2004 | Chen | |
| D487,174 | S | 2/2004 | Colman | |
| 6,689,466 | B2 | 2/2004 | Hartmann | |
| 6,703,127 | B2 | 3/2004 | Davis | |
| D495,456 | S | 8/2004 | Agren | |
| D497,699 | S | 10/2004 | Chi-Hsiang | |
| D499,023 | S | 11/2004 | Amos | |
| D505,762 | S | 5/2005 | Lalanne | |
| 6,895,626 | B2 | 5/2005 | Tsai | |
| D514,267 | S | 1/2006 | Tsai | |
| 6,990,708 | B2 | 1/2006 | Rosa | |
| D518,935 | S | 4/2006 | Leitch | |
| D521,701 | S | 5/2006 | Scheifele | |
| 7,038,416 | B2 | 5/2006 | Erko | |
| 7,048,804 | B2 | 5/2006 | Kisela | |
| 7,059,011 | B2 | 6/2006 | Capitani | |
| 7,137,169 | B2 | 11/2006 | Murphy | |
| 7,153,371 | B2 | 12/2006 | Hansen | |
| D543,324 | S | 5/2007 | Yoon | |
| D544,667 | S | 6/2007 | Nelson | |
| 7,225,503 | B1 | 6/2007 | Lenkiewicz | |
| 7,254,864 | B2 | 8/2007 | Cipolla et al. | |
| 7,266,292 | B1 | 9/2007 | Tsai | |
| D557,142 | S | 12/2007 | Karam | |
| D561,959 | S | 2/2008 | Hahn | |
| 7,362,064 | B2 | 4/2008 | Coates | |
| 7,380,307 | B2 | 6/2008 | Tsai | |
| 2001/0029911 | A1 | 10/2001 | Yang et al. | |
| 2002/0040503 | A1 | 4/2002 | Pace | |
| 2002/0061954 | A1 | 5/2002 | Davis et al. | |
| 2002/0062530 | A1 | 5/2002 | Fischer | |
| 2002/0094285 | A1 | 7/2002 | Paolini | |
| 2002/0106790 | A1 | 8/2002 | Cohen-Haguenauer | |
| 2002/0112741 | A1 | 8/2002 | Pieroni | |
| 2002/0112744 | A1 | 8/2002 | Besseling | |
| 2002/0170137 | A1 | 11/2002 | Coates | |
| 2003/0053643 | A1 | 3/2003 | Bank et al. | |
| 2003/0062723 | A1 | 4/2003 | Manci et al. | |
| 2003/0089383 | A1 | 5/2003 | Biggs | |
| 2003/0115711 | A1 | 6/2003 | Rosa | |
| 2004/0031506 | A1 | 2/2004 | Tsai | |
| 2004/0134016 | A1 | 7/2004 | Kisela | |
| 2004/0134025 | A1 | 7/2004 | Murphy | |
| 2004/0139572 | A1 | 7/2004 | Kisela | |
| 2004/0211189 | A1 | 10/2004 | Arnold | |
| 2004/0244138 | A1 | 12/2004 | Taylor | |
| 2005/0058874 | A1 | 3/2005 | Drake et al. | |
| 2005/0102789 | A1 | 5/2005 | Hopper | |
| 2005/0160553 | A1 | 7/2005 | Gregory | |
| 2006/0000041 | A1 | 1/2006 | Streutker | |
| 2006/0000049 | A1 | 1/2006 | Rosenzweig | |
| 2006/0000051 | A1 | 1/2006 | Cipolla | |
| 2006/0000052 | A1 | 1/2006 | Budd | |
| 2006/0150363 | A1 | 7/2006 | Choi | |
| 2006/0162117 | A1 | 7/2006 | Thomas | |
| 2006/0168755 | A1 | 8/2006 | Langerak | |
| 2006/0242775 | A1 | 11/2006 | Ho | |
| 2007/0062000 | A1 | 3/2007 | Murphy | |
| 2007/0079470 | A1 | 4/2007 | Rippl | |
| 2007/0130719 | A1 | 6/2007 | Zhou | |
| 2007/0143951 | A1 | 6/2007 | Wu | |
| 2007/0169304 | A1 | 7/2007 | Tsai | |
| 2007/0209139 | A1 | 9/2007 | Carlucci | |
| 2007/0231046 | A1 | 10/2007 | Whiffen | |
| 2008/0034514 | A1 | 2/2008 | Rosenzweig | |
| 2008/0066789 | A1 * | 3/2008 | Rosenzweig et al. | 134/106 |

FOREIGN PATENT DOCUMENTS

| | | |
|---|---|---|
| CN | 2540155 | 3/2003 |
| CN | 2568117 | 8/2003 |
| DE | 2431102 | 1/1976 |
| DE | 9110171 | 3/1993 |
| DE | 29822052 | 2/1999 |
| DE | 29910658 | 9/1999 |
| DE | 20001462 | 1/2001 |
| DE | 10015941 | 10/2001 |
| DE | 10205507 | 8/2003 |
| DE | 202006001189 | 4/2006 |
| EP | 0182754 | 5/1986 |

| | | |
|---|---|---|
| EP | 0253 910 | 9/1991 |
| EP | 1021 855 | 8/2000 |
| EP | 1027855 | 8/2000 |
| EP | 1113518 | 7/2001 |
| EP | 1224899 | 7/2002 |
| EP | 1243218 | 9/2002 |
| EP | 1329972 | 7/2003 |
| EP | 1554968 | 7/2005 |
| FR | 601312 | 2/1926 |
| FR | 701008 | 3/1931 |
| FR | 709689 | 8/1931 |
| FR | 2282252 | 3/1976 |
| FR | 2877204 | 5/2006 |
| GB | 1449483 | 8/1973 |
| GB | 2135869 | 9/1984 |
| GB | 2294196 | 4/1996 |
| GB | 2391797 | 2/2004 |
| GB | 2416526 | 2/2006 |
| JP | 54058954 | 5/1979 |
| JP | 64027526 | 2/1989 |
| JP | 01-099525 | 7/1989 |
| JP | 04-314411 | 11/1992 |
| JP | 09-066008 | 3/1997 |
| JP | 09-149872 | 6/1997 |
| JP | 09-154783 | 6/1997 |
| JP | 09-289960 | 11/1997 |
| JP | 09-289961 | 11/1997 |
| JP | 2001-275908 | 10/2001 |
| JP | 2001327449 | 11/2001 |
| JP | 2004337454 | 12/2004 |
| TW | 200520120479.9 | 5/2008 |
| WO | WO 97/28732 | 8/1997 |
| WO | WO 98/23385 | 6/1998 |
| WO | WO 99/26522 | 6/1999 |
| WO | WO 9944254 | 9/1999 |
| WO | WO 0029535 | 5/2000 |
| WO | WO 02/43550 | 2/2002 |
| WO | WO 2004/062457 | 7/2004 |
| WO | WO2004/062457 A2 * | 7/2004 |
| WO | WO 2004 094906 | 11/2004 |
| WO | WO 2006/049499 | 5/2006 |
| WO | WO2006/049499 A2 * | 5/2006 |
| WO | WO 2007/065371 | 6/2007 |
| WO | WO 2007/089116 | 8/2007 |
| WO | WO 2008/016741 | 2/2008 |
| WO | WO 2008/016761 | 2/2008 |

OTHER PUBLICATIONS

Patent Abstracts of Japan, vol. 2002, No. 03, Apr. 3, 2002, Pub. No. 2001327449 (Alpha Homes: KK);Nov. 21, 2001.

Euro-Pro Operating LLC: Steam Shark II Owner's Manual Model EP908EF; Nov. 2003; St. Laurent Quebec H4S 1A7, pp. 1-39.

Euro-Pro Operating LLC: Portable Steam Shark II Owner's Manual Model SC505; Jan. 2003; Champlain, NY12919, p. 7.

English language translation Patent Abstract of Japan 54058954 published May 12, 1979.

Pacific Northwest National Library paper entitled "Microheater" ca. Jul. 21, 1999 by Drost, et al.

English language translation Patent Abstract of Japan 2001-275908.

Intl. Search Report, mailed Feb. 14, 2007.

U.S. Appl. No. 11/496,143, filed Jul. 31, 2006.

* cited by examiner

STEAM MOP

The present invention claims priority on U.S. Provisional Patent Application Ser. No. 61/057,936 filed Jun. 2, 2008, all of which is incorporated herein by reference.

The present invention is directed to floor cleaning products, particularly to a floor mop, and more particularly to a steam floor mop.

BACKGROUND OF THE INVENTION

Hard floor surfaces such as wood floors, tile floors, linoleum floors, marble floors, granite floors, concrete floors, and the like are popular in homes and building structures. Commonly, foods, liquids, dirt and the like are dropped and/or tracked onto the floor surface, thereby staining the floor surface. Commonly, sponges, mops and the like are used to clean the floor surface. Various types of mops have been developed and a few are disclosed in U.S. Pat. Nos. D388,705; D420,561; D477,701; 5,888,006; 5,960,508; 5,988,920; 6,003,191; 6,045,622; 6,048,123; 6,101,661; 6,142,750; 6,328,543; 6,579,023; 6,601,261; 6,685,056; 6,722,806; 6,766,552; all of which are incorporated herein by reference. These mops include various features, structures and/or components which can be used in the steam mop of the present invention.

It has been found that many types of stains can be cleaned with the assistance of warm or hot water. Steam has also been found useful in cleaning tile grout and many hard to clean stains. Steam can also be used to facilitate in the cleaning of other types of surfaces.

Various types of steam mops and steam cleaners have been developed to clean floor surfaces. One such type of steam mops and steam cleaners are disclosed in U.S. Pat. Nos. D486,279; 5,386,612; 5,502,872; 5,907,879; 5,920,952; 6,571,421; 6,584,990; 6,895,626; 6,990,708; 7,059,011; 7,266,292; and United States Patent Publication Nos. 2002/0096201; 2003/0089383; 2006/01503632007/0079470; 2007/0130719; 2007/0169304; 2007/0209139; 2008/0034514; 2008/0066789; 2008/0236635; and 2009/0000051; and European Patent Publication Nos. EP1974647; EP1690488; EP1027855; and PCT Patent Application Publication Nos. WO 2009/008703; WO 2009/026203; and WO 2008/016741; all of which are incorporated herein by reference. Another commercially available steam mop is offered under the trade name THE SHARK. These steam mops include various features, structures and/or components which can be used in the steam mop of the present invention.

Although these various steam mops have been useful in the cleaning of various floor surfaces, many of the steam cleaning devices include a sponge or cleaning towelette through which steam is directed through, thus the stream does not directly contact the floor surface. In addition, these steam cleaning devices do not allow a user to easily direct steam to hard to access surfaces.

In view of the current state of the art of steam mops, there is a need for a steam mop that can direct steam directly onto a floor surface and which steam mop can be used to apply steam to hard to access surfaces.

SUMMARY OF THE INVENTION

The present invention is directed to a steam mop with which the steam can be directed onto a surface so as to clean the surface. The temperature of the steam from the steam mop can be selected so as to disinfect and/or sterilize a hard surface; however, this is not required. The steam mop can be designed to enable the steam generating device to be removed from the body of the steam mop so that the steam generating device can function as a hand-held unit which can be used to direct steam at hard to access surfaces (e.g., sink, area, counter surfaces, etc.); however, this is not required.

In one non-limiting aspect of the present invention, the steam mop includes a steam generator and a mop body. The mop body generally includes 1) a base mount for connecting the steam generator to the mop body, 2) an extension member connected to the base mount, 3) a handle connected to the extension member, and 4) a mop head connected to the base mount. As can be appreciated, the mop body can include other or additional components. As can also be appreciated, one or more of the components can be integrated into the steam generator; however, this is not required. The steam generator generally includes a liquid reservoir, a heating element, and a power cord and/or power source; however, this is not required. The steam generator can be designed to be permanently or removeably connected to the base mount. Although the steam generator generally includes a liquid reservoir or tank, it can be appreciated that the liquid reservoir or tank can be located on other or additional components of the steam mop. Likewise, if the steam generator is powered by a battery or other type of portable power supply, the power supply can be located in the stream generator and/or on other or additional components of the steam mop. The steam mop generally includes a manual and/or electrical pump that causes water or some other type of liquid in the liquid reservoir or tank to be directed to a heater in the steam generator to cause steam to be generated. As can be appreciated, one or more components of the manual and/or electrical pump can be located in the stream generator and/or on other or additional components of the steam mop. The mop head can include or be designed to be connected to one or more scrubbing and/or absorbent implements such as, but not limited to, a sponge, brush, towel, towelette or the like; however, this is not required. The scrubbing and/or absorbent implement can be releaseably connected to the mop head; however, this is not required. The scrubbing and/or absorbent implement, when used, can be connected to the mop head in a variety of ways and by a variety of arrangements. The mop head can be integrally formed with the base mount; however, this is not required. The mop head can be designed to move (e.g., pivot, swivel, etc.) relative to the base mount; however, this is not required.

In another and/or alternative non-limiting embodiment of the invention, the steam mop is designed to direct at least a portion of the steam on a floor surface that is in front of and/or behind the mop head. In many prior art steam mops, the generated steam is discharged from the base of the steam mop. In such a configuration, the steam is directed onto the top surface of the scrubbing and/or absorbent implement, thus little, if any, of the steam actually contacts a floor surface. In such prior art arrangements, the steam essentially heats and moistens the scrubbing and/or absorbent implement on the base of the steam mop. The steam mop of the present invention is designed to at least partially direct steam directly on a floor surface so as to improve the cleaning effectiveness of the steam mop. In one non-limiting embodiment of the invention, one or more steam nozzles are designed to direct one or more streams of steam forwardly of the mop head that is connected to the base mount of the steam mop. Such an arrangement enables steam to be applied directly onto a floor surface so as to facilitate in the loosening or dissolving of dirt, grime, etc. on the floor surface so that the scrubbing and/or absorbent implement on the mop head can better clean the floor surface. In one non-limiting design, 2-6 steam nozzles are connected to the base mount and/or mop head and project steam forwardly of the mop head. In another and/or alternative non-limiting embodiment of the invention, one or more steam nozzles are designed to direct one or more streams of steam rearwardly of the mop head that is connected to the base mount of the steam mop. In still another and/or alternative non-limiting embodiment of the invention, one or more steam nozzles are designed to direct one or more streams of steam into the mop head so that a portion of the steam is directed onto the top surface of the scrubbing and/or absorbent implement that is connected to the mop head.

In still another and/or alternative non-limiting embodiment of the invention, the steam mop is designed to enable the steam generator to be removably connected to the base mount of the steam mop so that the steam generator can also be used as a handheld cleaner to apply steam to hard to access locations, and/or to enable the steam generator to apply steam to areas other than a floor (e.g., sink, counter, wall, etc.). When the steam generator is designed to be removably connected to the base mount of the steam mop, the steam generator typically includes a self contained liquid reservoir, a heating element, a power cord and/or power source, and a manual or electric pump; however, this is not required. In this embodiment, the base mount is designed to releasably connect the steam generator to the steam mop. Many different arrangements can be used to enable the steam generator to be releasably connectable to the base mount. Such an arrangement enables the steam mop to function as a 3 in 1 tool, namely 1) a steam mop that generates steam, 2) a regular non-steam generating mop when the steam generator is detached form the steam mop, and 3) a hand-held steam generator. In a modification to this embodiment, the steam mop can include an accessory that can be attached to the base mount instead of the steam generator. For instance, a container that includes cleaning fluid can be connected to the steam mop instead of the steam generator so that the steam mop can apply cleaning fluid instead of steam to the floor surface. In some situations, a user may want to apply a cleaning fluid to the floor instead of a steam. Due to the configuration of the steam generator, certain types of cleaning fluids may potentially damage the steam generator, especially when such cleaning fluids are heated. Furthermore, the user many not want to vaporize certain cleaning fluids when cleaning a floor surface. As such, the steam mop of the present invention can include a container that can be substituted for the steam generator to allow the user to increase the versatility of the steam mop of the present invention. The container can be filled with water or various types of cleaning solutions. In this arrangement, non-heated water or non-heated cleaning solution would be applied to the floor surface. As such, the steam mop thus becomes a 4 in 1 tool.

In yet another and/or alternative non-limiting embodiment of the invention, the steam mop is designed to enable the user to hand pump liquid into the steam generator. In one non-limiting arrangement, the handle and extension member and/or the extension member and the base mount include a manual pump mechanism and/or a manual mechanism that activates a pump mechanism in the steam generator. In one non-limiting design, the handle is designed to pivot relative to the extension member so as to at least partially activate a pump that is located in the extension member, the base mount, and/or the steam generator. In such a design, a user pivots the handle during use of the steam mop to cause the pump to actuate and thereby cause fluid to enter the heating element in the steam generator so that steam is generated by the steam generator. In another non-limiting design, the handle is designed to telescopically receive a portion of the extension member so as to at least partially activate a pump that is located in the extension member, the base mount, and/or the steam generator. In such a design, a user pushes the handle to cause a portion of the extension member to move into and out of a cavity in the handle during the use of the steam mop to cause a pump to actuate and thereby cause fluid to enter the heating element in the steam generator so that steam is generated by the steam generator. In still another non-limiting design, the extension member is designed to telescopically receive a portion of the handle so as to at least partially activate a pump that is located in the extension member, the base mount, and/or the steam generator. In such a design, a user pushes the handle to cause a portion of the handle move into and out of a cavity in the extension member during the use of the steam mop to cause a pump to actuate and thereby cause fluid to enter the heating element in the steam generator so that steam is generated by the steam generator. In yet another non-limiting design, the extension member is designed to telescopically receive a portion of the base mount so as to at least partially activate a pump that is located in the extension member, the base mount, and/or the steam generator. In such a design, a user pushes the handle to cause a portion of the base mount move into and out of a cavity in the extension member during the use of the steam mop to cause a pump to actuate and thereby cause fluid to enter the heating element in the steam generator so that steam is generated by the steam generator. In still yet another non-limiting design, the base mount is designed to telescopically receive a portion of the extension member so as to at least partially activate a pump that is located in the extension member, the base mount, and/or the steam generator. In such a design, a user pushes the handle to cause a portion of the extension member move into and out of a cavity in the base mount during the use of the steam mop to cause a pump to actuate and thereby cause fluid to enter the heating element in the steam generator so that steam is generated by the steam generator. In a further non-limiting design, a pump lock can be used in any of the manual pump arrangements discussed above; however, this is not required. The pump lock, when used, can be designed to deactivate the pump so that even when there is some pivot action or telescopic movement of one or more components of the steam mop, the pump does not actuate; however, this is not required. In addition or alternatively, the pump lock can be used to prevent some pivot action or telescopic movement of one or more components of the steam mop during use of the steam mop, thereby preventing actuation of the pump of the steam mop; however, this is not required. As can be appreciated, many different arrangements can be used for the pump lock, when used.

In still yet another and/or alternative non-limiting embodiment of the invention, the steam mop is designed to enable the user to pump liquid (e.g., water, etc.) into the steam generator by use of an electric motor. In one non-limiting arrangement, the handle includes a switch that enables a user to actuate the switch to thereby activate and deactivate a motor pump that is located in the handle, the extension member, the base mount and/or the steam generator.

In another and/or alternative non-limiting embodiment of the invention, the steam mop can be designed to include a pivoting and/or swivel connection between the base mount and mop head so as to facilitate maintaining the desired orientation of the scrubbing and/or absorbent implement on the mop head as the scrubbing and/or absorbent implement is moved over a floor surface.

In still another and/or alternative non-limiting embodiment of the invention, the steam mop includes a handle; an extension member; a base mount; a steam generator that includes a manual liquid pump, a liquid tank, a heating element; a mop head; and a scrubbing and/or absorbent implement. The scrubbing and/or absorbent implement can be designed to be removably connected to the mop head. The mop head can be designed to have a pivot and/or swivel connection to the base mount so as to facilitate in maintaining the desired orientation of the scrubbing and/or absorbent implement on a floor surface as the scrubbing and/or absorbent implement is moved over the floor surface. The steam generator includes a housing that at least partially encases the manual liquid pump, the liquid tank, the heating element. The housing of the steam generator can be designed to be releasably connected to the base mount of the steam mop. The manual pump actuation arrangement can be formed by the extension member and the base mount so as to manipulate the amount of liquid directed into the heating element of the steam generator. The housing of the steam generator can also include a separate pump actuation arrangement used to manipulate the amount of liquid directed into the heating element of the steam generator.

In yet another and/or alternative non-limiting embodiment of the invention, the steam mop includes a steam generator that includes a housing and an electric heating element that is used to at least partially vaporize liquid.

In still yet another and/or alternative non-limiting embodiment of the invention, the steam mop is designed to generate steam by pushing the handle of the steam mop during the use of the steam mop. The steam generated by the steam mop can be used to clean and/or high-temperature disinfect and/or sterilize a hard surface.

In another and/or alternative non-limiting embodiment of the invention, the steam generator includes a specially designed heating element that at least partially preheats liquid prior to vaporizing the liquid. In many prior art heating elements, a liquid is aimed directly onto a heated portion of the heating element to cause the liquid to vaporize on contact with the heated portion. However, when too much liquid is conveyed to the heated portion of the heating element, some of the liquid does not have time to vaporize, thus exiting the heating element still in liquid form. The heating element of the present invention is designed to preheat at least a portion of the liquid prior to the liquid contacting the heated portion of the heating element that is used to vaporize the liquid. The preheating of the liquid in the heating element results in the liquid substantially completely vaporizing when such preheated liquid contacts the heated portion of the heating element. The complete or substantially complete vaporization of the liquid in the heating element results in a drier steam being formed by the heating element as compared with prior art heating elements. The drier steam is believed to be more effective in cleaning hard surfaces. In addition, the drier stream can be used to clean carpets, upholstery, and other fabric surfaces.

In still another and/or alternative non-limiting embodiment of the invention, the steam generator includes a specially designed heating element that divides the liquid pumped to the heating element into a plurality of liquid streams. One or more of the liquid streams can be preheated prior to the vaporization of the liquid stream; however, this is not required. One or more of the liquid streams can be combined together prior to being directed on to the heated portion of the heating element that is used to vaporize the liquid; however, this is not required. One or more of the liquid streams can be directed to different regions on the heated portion of the heating element that is used to vaporize the liquid; however, this is not required. The dividing of the liquid streams in the heating element has been found to result in the liquid being substantially completely vaporized when such liquid contacts the heated portion of the heating element. The complete or substantially complete vaporization of the liquid in the heating element results in a drier steam being formed by the heating element as compared with prior art heating elements.

In one non-limiting object of the present invention, there is provided a steam mop which can distribute steam on a hard surface such as a floor.

In another and/or alternative one non-limiting object of the present invention, there is provided a steam mop that is compact, easy to maneuver, and simple and safe to use.

In still another and/or alternative one non-limiting object of the present invention, there is provided a steam mop particularly adapted for cleaning floors in the home.

In yet another and/or alternative one non-limiting object of the present invention, there is provided a steam mop which can distribute steam on a hard surface by pushing the handle of the steam mop.

In still yet another and/or alternative one non-limiting object of the present invention, there is provided a steam mop which can distribute steam on a hard surface by pushing the handle of the steam mop wherein in the handle includes a telescoping pump mechanism.

In another and/or alternative one non-limiting object of the present invention, there is provided a steam mop which can perform cleaning work in a convenient and time and labor efficient manner.

In still another and/or alternative one non-limiting object of the present invention, there is provided a steam mop which can high temperature disinfect and/or sterilize a hard surface.

In yet another and/or alternative one non-limiting object of the present invention, there is provided a steam mop which includes a removable steam generator for handheld use.

In still yet another and/or alternative one non-limiting object of the present invention, there is provided a steam mop which directs steam forwardly of the base of the mop head so that steam directly contacts a hard surface to be cleaned.

In another and/or alternative one non-limiting object of the present invention, there is provided a steam mop generating dry stream.

These and other objects and advantages will become apparent to those skilled in the art upon reading and following the description taken together with the accompanying drawings.

BRIEF DESCRIPTION OF THE DRAWINGS

Reference may now be made to the drawings which illustrate various preferred embodiments that the invention may take in physical form and in certain parts and arrangement of parts wherein.

DETAILED DESCRIPTION OF THE NON-LIMITING EMBODIMENT

Figure 1:
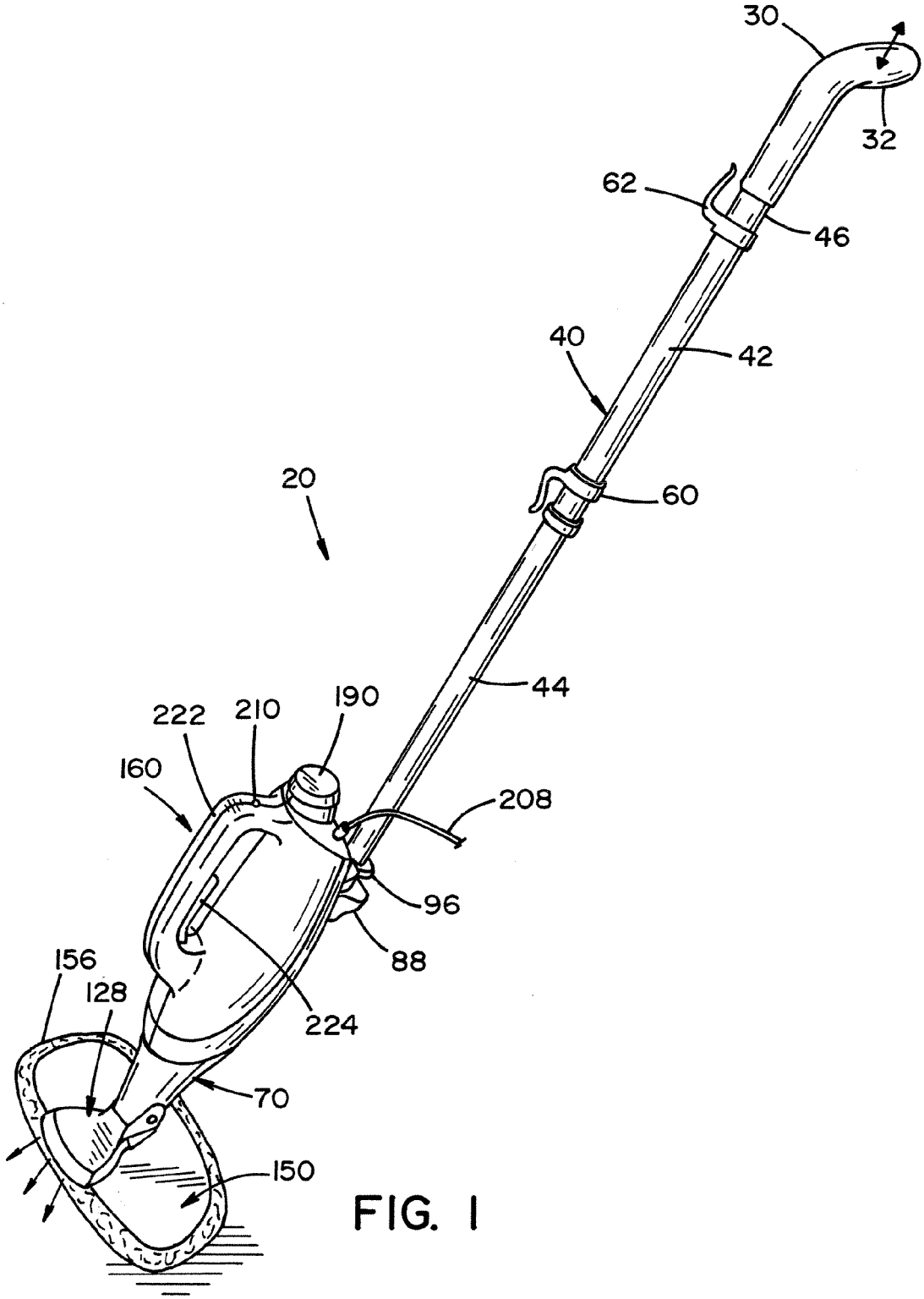
FIG. 1 is a perspective view of one non-limiting embodiment of the steam mop of the present invention.

Referring now to the drawings wherein the showings are for the purpose of illustrating a preferred embodiment of the invention only and not for the purpose of limiting same, FIGS. 1-10 illustrate one non-limiting embodiment of the present invention.

FIG. 1 illustrates a steam mop 20 comprising a handle 30, an extension member 40, a base mount 70, a mop head 150 a cleaning cloth 156 that is removably connected to the mop head 150, and a steam generator 160.

The handle 30 is illustrated as having a bend top portion to facilitate in the grasping of the handle by a user. As can be appreciated, the bend portion on the handle is optional. Indeed, the handle can have many different configurations to make the handle ergonomically pleasing for use by a user and/or to facilitate in the grasping of the handle. All such configurations can be used in the present invention. The materials used to form the handle are non-limiting. The handle can include a compressible portion for facilitating in the grasping of the handle; however, this is not required. The handle can include gripping materials for facilitating in the grasping of the handle; however, this is not required.

Handle 30 is illustrated as being connected to a top end 46 of extension member 40. The handle can be integrally formed on the top end 46 of the extension member or be designed to connect to the top end 46 of the extension member during the assembly of the steam mop. When handle 30 is designed to be connected to the top end 46 of the extension member, the manner in which the connection is formed is non-limiting. The handle can be designed to move (e.g., pivot, swivel, twist, move along the longitudinal length of the extension member, etc.) relative to top end 46 of the extension member, or be designed to be rigidly connected to the top end 46 of the extension member. As illustrated in FIG. 1, handle 30 is rigidly connected to the top end 46 of the extension member.

The extension member 40 can be formed of a single piece or be formed of multiple pieces. When the extension member is formed of multiple pieces, the pieces can be secured together in any number of ways. As illustrated in FIG. 1, the extension member 40 is formed of an upper section 42 and a lower section 44. The length of the lower and upper sections is non-limiting. Generally, the length of the two sections is about the same; however, this is not required. The extension member can be formed of any number of materials. The length of the extension member is non-limiting. The cross-sectional shape of the extension member is illustrated as being generally circular; however, other cross-sectional shapes can be used. The extension member can be formed from a tubular material; however, this is not required.

Two cord brackets 60, 62 are illustrated as being connected to upper section 42. The cord brackets are optional. The cord brackets, when used, can be used by a user to wind the power cord 208 that is used to supply power to the steam generator 160.

Figure 2:
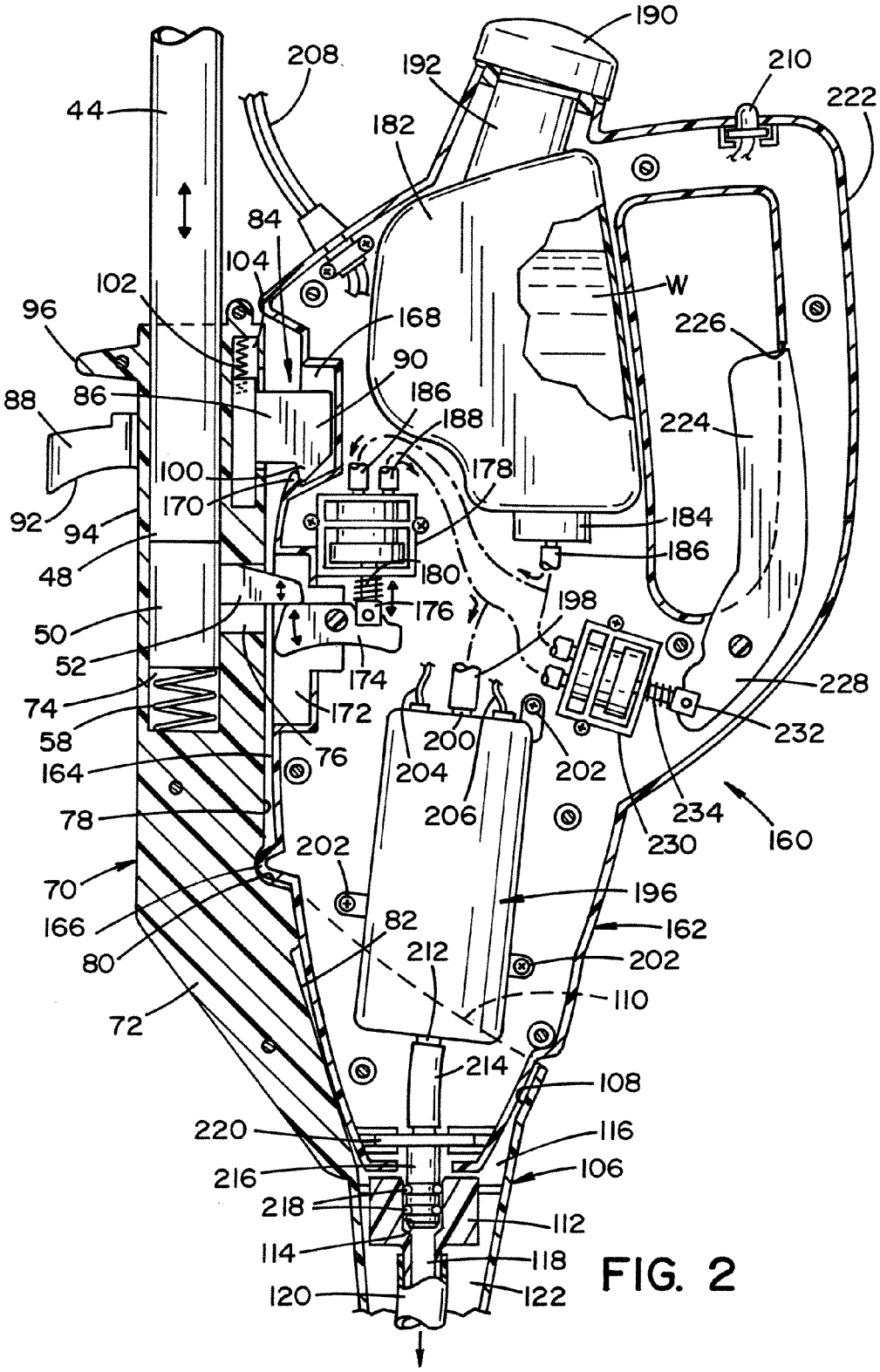
FIG. 2 is a cross-section view of the steam generator that is mounted in the base mount of the steam mop.

Referring now to FIG. 2, the bottom end 48 of the extension member 40 is positioned in a tube cavity 74 of base mount 70. Tube cavity 74 has a cross-section shape, cross-sectional size and longitudinal length to enable the lower portion of the lower section 44 of the extension member to move along a portion of the longitudinal length of the tube cavity. Generally the cross-sectional shape of the tube cavity is the same or similar to the cross-sectional shape of the lower portion of the lower section 44 of the extension member; however, this is not required. Generally, the cross-sectional size of the tube cavity is slightly larger than the cross-sectional size of the lower portion of the lower section 44 of the extension member; however, this is not required. The longitudinal length of the tube cavity is non-limiting.

As illustrated in FIG. 2, a leg extension 50 is designed to engage the bottom end 48 of the extension member 40. The leg extension 50 can be connected the bottom end 48 of the extension member 40; however, this is not required. When the bottom end 48 of the extension member 40 is connected to the leg extension 50, leg extension 50 can be integrally formed on the bottom end 48 of the extension member 40; however, this is not required. As illustrated in FIG. 2, leg extension 50 is a separate component from lower section 44 of the extension member and is not connected to the lower section 44 of the extension member. In this arrangement, the leg extension 50 is maintained within the tube cavity 74. Any number of means can be used to maintain the leg extension 50 within the tube cavity. In addition, the lower portion of the extension member 40 is designed to be movably secured in the tube cavity so as to allow limited longitudinal movement within the tube cavity, but prevent the lower portion of the extension member 40 from being fully removed from the tube cavity. Many different means can be used to allow for such a connection arrangement. The connection arrangement can also be used to limit the rotational movement of the extension member within tube cavity 74; however, this is not required. The tube cavity and/or the lower portion of the extension member can include a releasable connector that would enable a user to release the lower portion of the extension member from the tube cavity; however, this is not required.

As illustrated in FIG. 2, leg extension 50 includes a side arm 52 that extends through side opening 76 of the tube cavity 74. The height of the side opening 76 can be used to limit the amount of longitudinal movement of the leg extension 50 within tube cavity 74; however, this is not required. The width of the side opening 76 can also be used to limit the rotational movement of the leg extension 50 within tube cavity 74; however, this is not required. As will be discussed in more detail below, leg extension 50 is used to actuate a pump in steam generator 160 when the leg extension 50 is moved longitudinally within tube cavity 74 during operation by a user.

As also illustrated in FIG. 2, a biasing member 58 is positioned in the base of the tube cavity. The biasing member 58 is generally in the form of a spring; however, other or additional types of biasing members can be used. The biasing member can be connected to the base of the tube cavity and/or to the bottom of leg extension 50; however, this is not required. The biasing member is designed to bias the leg extension 50 away from the base of the tube cavity. As can be appreciated, other or additional means can be used to bias leg extension 50 away from the base of the tube cavity.

Figure 5:
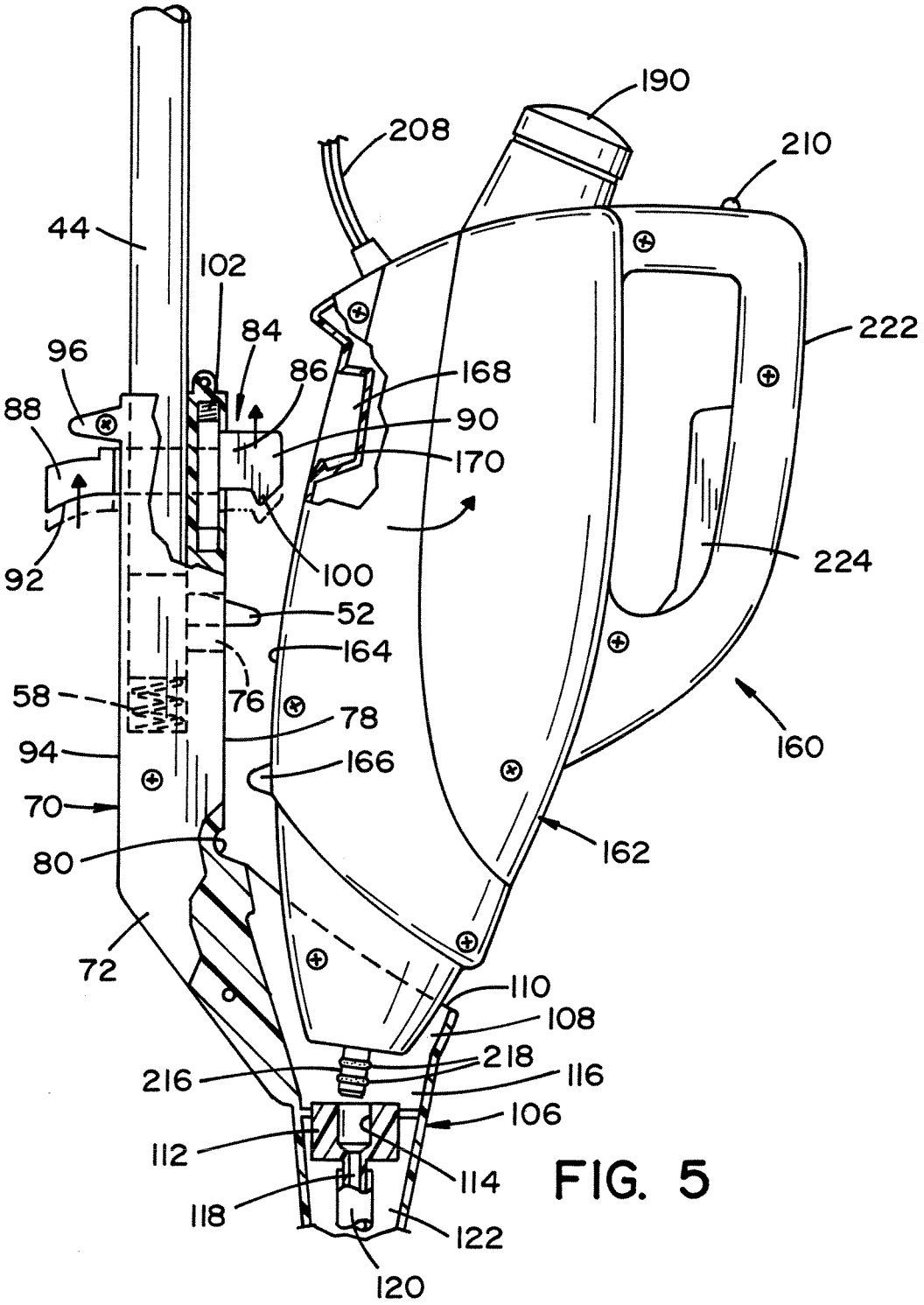
FIG. 5 illustrates the steam generator being releasably connected to the base mount of the steam mop.

Referring now to FIGS. 1, 2 and 5, base mount 70 is designed to releasably connect steam generator 160 to the steam mop 20. The base mount can be formed of one or more pieces. When the base mount is formed of more than one piece, the pieces can be connected together in a number of way. The materials used to form the base mount are non-limiting. Base mount 70 includes a body 72 that includes a tube cavity 74 having a side opening 76 that form a passageway to the front face 78 of body 72. The front face 78 of body 72 is shaped and contoured to mate with the bottom face 164 of the body 162 of the steam generator 160 as illustrated in FIG. 2. One portion of the front face includes a notch 80 that functions as a landing for a rib portion 166 on the bottom face 164 of the body 162 of the steam generator 160. As can be appreciated, notch 80 is an optional feature on the front face 78 of body 72. The bottom portion of the front face includes a sloped portion 82 that begins below notch 80. As can be appreciated, sloped portion 82 is optional. As also can be appreciated, the front face 78 of body 72 can include other or additional configurations, profiles and the like that can be used to mate with bottom face 164 of the body 162 of the steam generator 160 and/or to stabilize the steam generator 160 when mounted to base mount 70.

A locking mechanism 84 is located on the top portion of the base mount 70. The locking mechanism is designed to releasably lock the body 162 of the steam generator 160 to the front face 78 of body 72 of base mount 70. As can be appreciated, other or additional arrangements can be used to releasably lock the body 162 of the steam generator 160 to the front face 78 of body 72 of base mount 70. As illustrated in FIGS. 2 and 5, locking mechanism 84 includes a locking latch 86 having a lift arm 88 and lock leg 90. The lift arm 88 includes a curved profiled for the bottom surface 92 that is shaped to facilitate in a user grasping the bottom surface with one or more fingers and upward lift the lift arm. As can be appreciated, the curved profiled of bottom surface 92 is optional. As also can be appreciated, bottom surface 92 can have other or additional configurations to facilitate in a user grasping the bottom surface with one or more fingers and upward lift the lift arm. The back face 94 of body 72 includes a flange 96 that can also be used by a user to facilitate in upwardly lift the lift arm 88. As can be appreciated, flange 96 is optional. The locking latch 86 is designed to be biased in a downward position by a biasing arrangement 102. As illustrated in FIGS. 2 and 5, the biasing arrangement is in the form of a spring; however, other or additional arrangements can be used to bias the locking latch 86 in a downward position. As also can be appreciated, the use of a biasing arrangement is optional. The biasing arrangement is illustrated as being positioned in a spring cavity 104 that is located in body 72 of base mount 70.

As illustrated by the arrows in FIG. 5, the upward lifting of lift arm 88 results in the locking latch 86 being upwardly lifted. The lift arm can be designed to be inserted through a locking slot in body 72 of base mount 70, not shown, or be configured to be inserted about a portion of the base mount. As can be appreciated, many different configurations for the locking latch 86 can be used. The upward lifting of locking latch 86 results in the upward lift of lock leg 90. As illustrated in FIG. 2, when locking latch 86 is a lower locked position, lock leg 90 is positioned in the lock cavity 168 in the body 162 of the steam generator 160. Lock leg 90 includes a downward extension 100 that is designed to engage a wall 170 of lock cavity 168 to thereby secure the body 162 of the steam generator 160 to the front face 78 to body 72 of base mount 70. When the lift arm 88 is lifted as illustrated by the arrows in FIG. 5, the downward extension 100 on lock leg 90 is caused to lift upwardly and out of lock cavity 168 in the body 162 of the steam generator 160, thereby releasing the body 162 of the steam generator 160 to the front face 78 to body 72 of base mount 70. Thereafter, the steam generator 160 can be removed from base mount 70 as illustrated by the arrow in FIG. 5.

Figure 3:
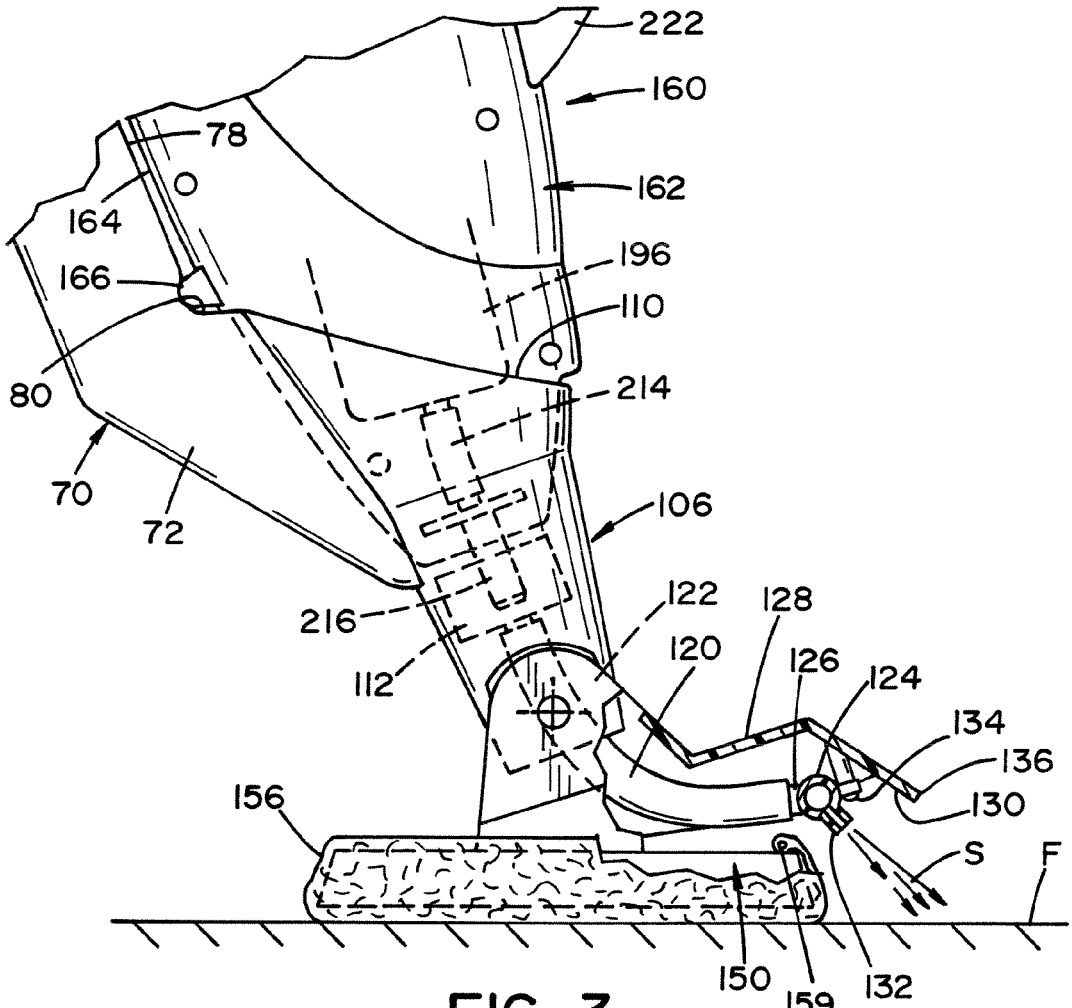
FIG. 3 is a partial sectional view of the mop head of the steam mop that is connected to the base mount.

As best illustrated in FIGS. 2, 3 and 5, a steam nozzle receptacle 106 forms the bottom portion of base mount 70. The steam nozzle receptacle can be integrally formed with the base mount 70 or can be connected to the base mount 70 by a variety of means. As illustrated in FIGS. 2, 3 and 5, the steam nozzle receptacle can be integrally formed with the base mount. The interior cavity 108 of the steam nozzle receptacle has a generally conical shape; however, the interior cavity 108 of the steam nozzle can have other shape. The top portion 110 of the cavity 108 can be formed at an angle to facilitate in the insertion and the removal of the end of the stream generator in and out of the cavity; however, this is not required. As can be appreciated, the top portion of the cavity can be shaped in many different ways.

A nozzle interface 112 that includes a nozzle cavity 114 is positioned in the base of cavity 108. The nozzle cavity is designed to at least partially telescopically receive a portion of the end of vapor nozzle 216 of the steam generator 160. The nozzle interface can be integrally formed in the base of the cavity or be connected to the cavity in any number of ways. Positioned adjacent to the nozzle interface 112 is a drain passage 116 to allow liquid to drain from the base of cavity 108. The inclusion of the drain passage in cavity 108 is not required. As best illustrated in FIG. 2, a steam passage 118 is fluidly connected to the bottom of the nozzle cavity 114. Connected to the end of the steam passage is a steam hose 120. The steam hose can be connected to the end of the steam passage in a variety of ways. The steam hose is generally a flexible hose; however, this is not required. The steam hose can include a insulating covering; however, this is not required. As illustrated in FIG. 3, the steam hose passes through the bottom cavity 122 of the base mount and connects to an inlet opening 126 of the front sprayer 124.

Figure 4:
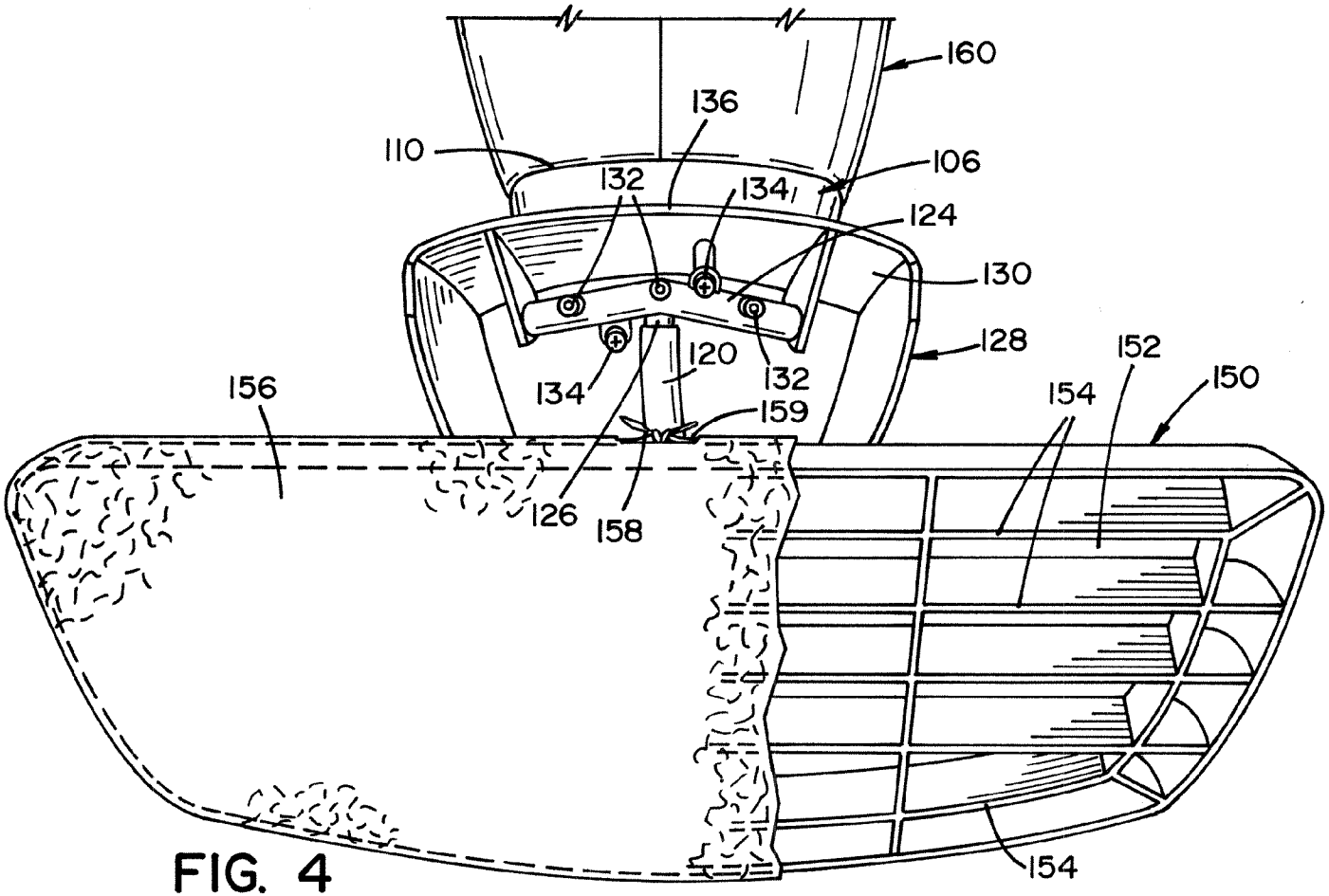
FIG. 4 is a bottom view of the mop head and a section view of the scrubbing and/or absorbent implement that is connected to the mop head.

Referring now to FIGS. 3 and 4, the front sprayer 124 is connected to the bottom surface 130 of the spray cover 128. The front sprayer 124 is illustrated in FIG. 4 as having a slight V-shape; however, this is not required. The spray cover is illustrated in FIG. 3 as being connected to mop head 150 and steam nozzle receptacle 106 of the base mount; however, this is not required. As illustrated in FIG. 3, the steam nozzle receptacle 106 is pivotally connected to the spray cover 128 and the mop head is rigidly connected to the spray cover 128. The rigid connection between the mop head and the spray cover 128 results in a set relationship between the three sprayers 132 on the front sprayer 124 and the mop head 150. The three sprayers 132 are positioned on the underside of the spray cover 128 so as to direct steam that is flowing into the front sprayer 124 forwardly of the mop head so that the steam contacts floor surface F during the use of the steam mop as illustrated in FIG. 3. As illustrated in FIG. 4, one or more screws 134 are used to secure front sprayer 124 to the bottom surface 130 of the spray cover 128; however, it will be appreciated that other or additional connection arrangements can be used. One or more of sprayers 132 can be configured to direct steam forwardly of the mop head. As can be appreciated, front sprayer 124 can include less than three sprayers 132 or more than three sprayers 132. As can also be appreciated, one or more of the sprayers 132 can direct steam forwardly of the mop head 150 and one or more of the sprayers 132 can direct steam fully or partially on the mop head and/or cleaning cloth 156 that is connected to the mop head. As can also be appreciated, two or more of the sprayers 132 can direct steam at the same or different distance forwardly of the mop head 150. Generally, sprayers 132 direct a majority of the steam at about 0.25-6 inches forwardly of the mop head 150 the mop head and/or cleaning cloth 156 is contacting the floor surface, and typically about 0.25-4 inches forwardly of the mop head 150; however, other distances can be set. The front lip 136 of the spray cover 128 is illustrated in FIG. 3 as angling downwardly toward the floor surface F when the mop head and/or cleaning cloth 156 is contacting the floor surface. This configuration of the spray cover facilitates in directing steam S exiting the sprayers 132 to the floor surface as illustrated in FIG. 3. As can be appreciated, this design of the spray cover is optional and many other configurations of the spray cover can be used. As mentioned above, the rigid connection between the mop head and spray cover 128 results in sprayers 132 always directing steam to a desired location on floor surface F during the operation of the steam mop. The rigid connection between the mop head and spray cover 128 can be achieved in many different ways. The mop head and spray cover can be formed of one piece or can be formed of a plurality of pieces. The pivot connection between the steam nozzle receptacle 106 and spray cover 128 allows a user to move the handle 30 upwards and downwards during the cleaning of floor surface F while also maintaining mop head in contact with the floor surface and also steam to a desired location on floor surface F during the operation of the steam mop. The pivot connection between the steam nozzle receptacle 106 and spray cover 128 can be formed in a variety of ways.

As illustrated in FIGS. 3 and 4, the mop head 150 includes a cleaning cloth 156 connected to the mop head. The cleaning cloth 156 is generally designed to be removably connected to the mop head so that the cleaning cloth 156 can be periodically washed and/or replaced. The cleaning cloth 156 can be formed of many different materials. The cleaning cloth 156 may include a stretchable band or string type arrangement 158 that is threaded through opening 159 at an edge of the cleaning cloth. The stretchable band or string type arrangement 158 is used to secure the cleaning cloth to the mop head; however, it can be appreciated that other or additional means can be used to connect the cleaning cloth to the mop head. Non-limiting arrangements of various additional or alternative arrangements for connecting the cleaning cloth to the mop head 150 are illustrated in US 2003/0089383; US 2007/0130719; U.S. Pat. Nos. 6,584,990; 6,895,626; 6,990,708; and 7,266,292, all of which are incorporated herein by reference. The base 152 of the mop head includes a plurality of ribs 154; however, this is not required. As can be appreciated, base 152 can be a flat surface or have some other configuration.

Referring now to FIGS. 2, 3 and 5, the steam generator 160, as mentioned above, is designed to be releasably connected to the base mount 70. Steam mop 160 includes a body 162 having a bottom face 164 that is designed to engage and connected to the base mount 70. A positioning rib 166 is located on bottom face 164 and is designed to be at least partially inserted into notch slot 80 in the front face 78 of body 72 of base mount 70. As mentioned above, when the steam generator is connected to the base mount, the positioning rib 166 and the slot 80 are used to properly position the steam generator in base mount. As can be appreciated, positioning rib 166 and/or the slot 80 are optional. As can be appreciated, positioning rib 166 and back leg 167 can be used to enable the steam generator to be set on a flat surface when the steam generator is removed form the base mount 70; however, this is not required. Bottom face 164 also includes a lock cavity 168 that is designed to receive a portion of lock leg 90 of locking latch 86. As illustrated in FIG. 2, the downward extension 100 on lock leg 90 is designed to engage wall 170 in lock cavity 168 to thereby releasably secure the steam generator to the base mount. As illustrated in FIG. 5, the steam generator is easily released from the base mount by merely lifting lift arm 88 as illustrated by the arrows to cause downward extension 100 on lock leg 90 to lift upwardly and release from wall 170 in lock cavity 168, thereby enabling the body 162 of the steam generator 160 to be lifted out of the base mount as illustrated by the arrow in FIG. 5. As is readily apparent from the sloped configurations of downward extension 100 on lock leg 90 and the front face of wall 170 in lock cavity 168, such sloped surfaces facilitate in the re-connection of the body of the steam generator to the base mount. As can be appreciated, such sloped surfaces are optional. As can also be appreciated, the lock leg 90 and/or wall 170 can include other or additional configurations to facilitate in the connection and/or removal of the steam generator to/from the base mount.

Referring now to FIG. 2, the bottom face 164 of body 162 of the steam generator includes a pump slot 172. Positioned in the pump slot is the front portion of a pump leg 174. The rear portion of the pump leg is connected to the end of a pump piston 176 of pump 178. Pump 178 is illustrated as being a manual pump; however, it can be appreciated that pump 178 can be an electric pump. A pump spring 180 is positioned between the end of the pump piston and the housing of pump 178 to bias the pump piston in an extended position. As can be appreciated, pump spring can be designed to bias the pump piston in an unextended position. The use of pump spring 180 is optional. The top surface of the front portion of a pump leg 174 is designed to engage the bottom surface of side arm 52 of leg extension 50. As illustrated by the arrows in FIG. 2, when a user pushes and pulls the steam mop over a floor surface F, such action causes the lower section 44 of the extension member to move longitudinally in tube cavity 74. Such longitudinal movement of lower section 44 results in the upward and downward movement of side arm 52 within side opening 76 of the base mount as illustrated by the arrow in FIG. 2. The upward and downward movement of side arm 52 in turn causes pump leg 174 to also move upwardly and downwardly in pump slot 172 as illustrated by the arrow in FIG. 2. The upward and downward movement of pump leg 174 causes pump piston 176 of pump 178 to create a pump action in pump 176 as illustrated by the arrow in FIG. 2. The actuation of pump 176 causes fluid W in fluid tank 182 to be drawn through tank opening 184 and into a fluid tube 186 and then to pump 176. Pump 176 then causes the fluid to flow from pump 176 through another fluid tube 186 to the heating element 196 of the steam generator. The arrows in FIG. 2 illustrate one non-limiting tubing and pumping configuration to enable fluid such as water to be pumped from the fluid tank 182 to the heating element 196 of the steam generator when the steam generator is connected to the base mount and a user is using the steam mop to clean a floor surface F. As can be appreciated, the positioning of one or more components in the body 162 of the of the steam generator 160 is non-limiting; as such the component configuration illustrated in FIG. 2 is just one of many component configurations that can be used.

As illustrated in FIG. 2, the fluid tank 182 is designed to supply fluid to the heating element 196 of the steam generator. The fluid tank can be filled by a user by simply removing cap 190 located on the outside surface of body 162. The cap is generally thread onto body 162; however, cap 190 can be secured to body 162 in other ways. When cap 190 is removed, user can empty fluid tank 182 by pouring any liquid in the fluid tank out of top tank opening 192, or can fill the fluid tank by pouring fluid into top tank opening 192.

Figure 12:
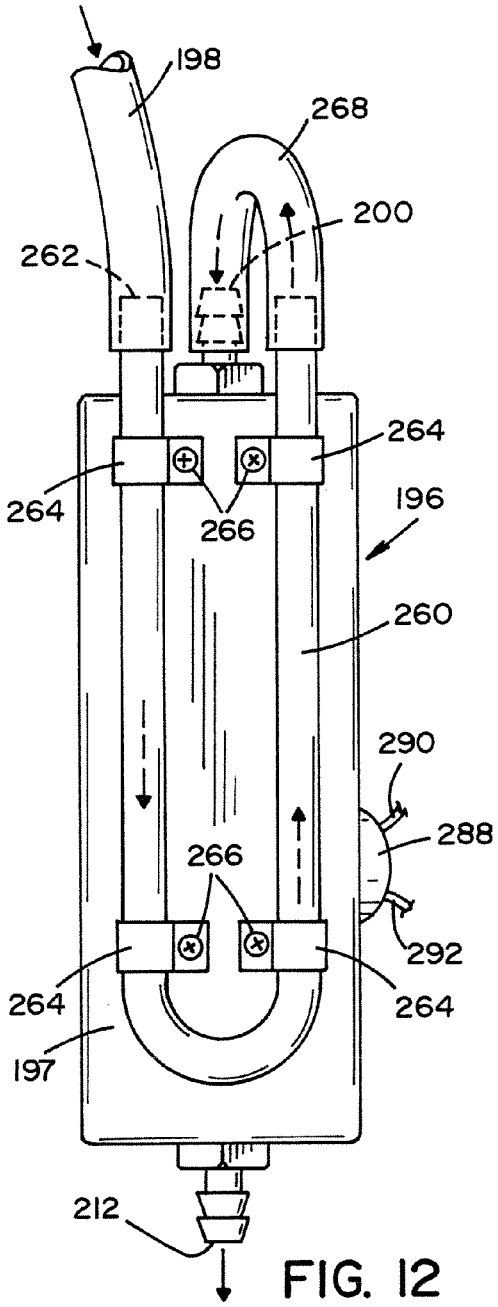
FIG. 12 a bottom view of the heating element of FIG. 11.
Figure 11:
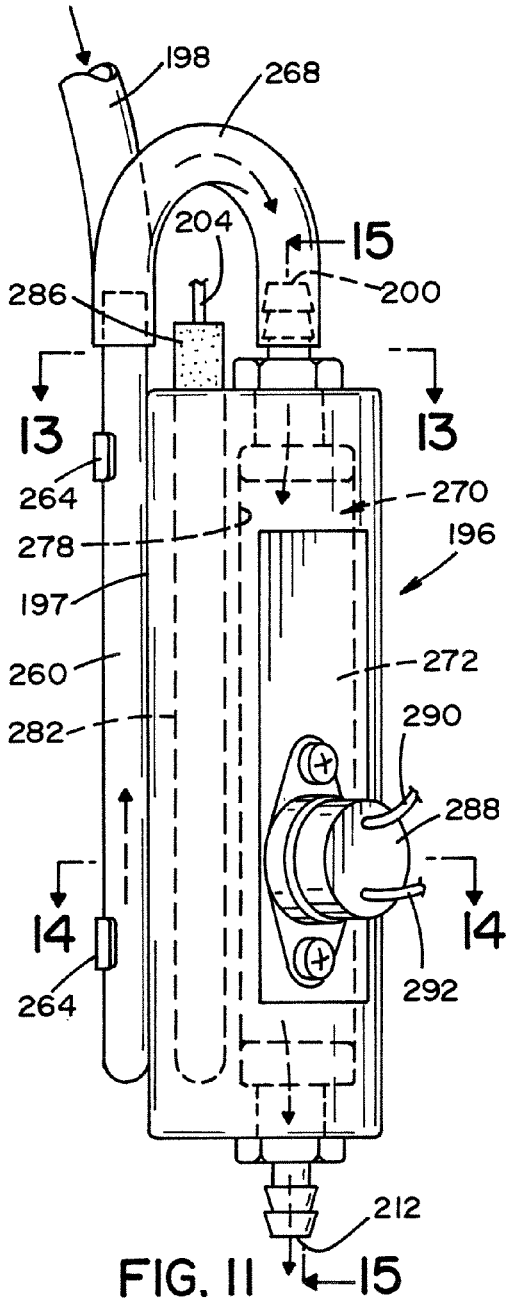
FIG. 11 is one non-limiting perspective view of the heating element of the steam generator.
Figure 13:
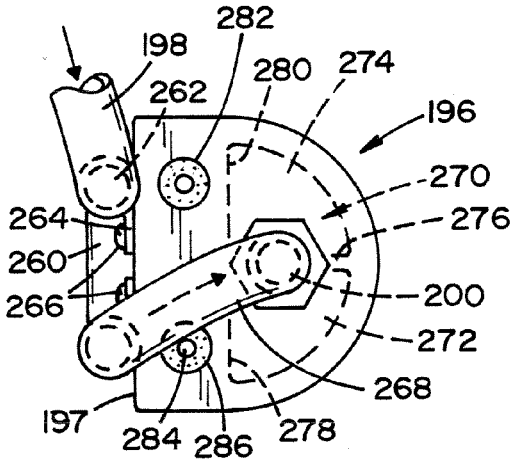
FIG. 13 is a cross-sectional view along line 13-13 of FIG. 11.

As mentioned above, heating element 196 is designed to vaporize fluid such as water that is directed to the heating element 196. The heating element can have many different configurations. In one non-limiting configuration, the heating element 196 includes an optional preheating tube 260 that is connected to the outer body surface of the heating element as illustrated in FIGS. 11-14. The preheating tube, when used, is generally formed of a heat conducting metal material. As illustrated in FIGS. 11-13, when the heating element includes preheating tube 260, a fluid tube 198 directs fluid into an entry opening 262 of the preheating tube 260. When the heating element does not include a preheating tube, fluid tube 198 directs fluid into opening 200 of the heating element 196 as illustrated in FIG. 2. As illustrated in FIG. 12, preheating element 260 is connected to the bottom surface 197 of the heating element by brackets 264. The brackets are illustrated as being connected to bottom surface 197 by screws 266. As can be appreciated, the preheating tube can be connected to the heating element in other or additional ways (e.g., weld, solder, adhesive, etc.). The preheating tube is illustrated as a U-shaped component; however, many other shapes can be used. The preheating tube is illustrated as being connected to the bottom surface of the heating element; however, it can be appreciated that the preheating tube can be connected to other or additional regions of the heating element. When the heating element is activated, the heating element can be designed to allow one or more portions of the body surface to rapidly rise in temperature. On these one or more portions of the body surface, the preheating tube can be connected to cause fluid in the preheating tube to be preheated as the fluid flows through the tube as indicated by the arrows in FIGS. 11-13. It has been found that a drier steam can be formed by the preheating of the fluid.

Once the fluid is preheated, the preheated fluid can then be directed into the main heating chamber of heating element 196. As illustrated in FIGS. 11-13, the preheated fluid exiting the preheating tube enters tube 268 that is designed to direct fluid into opening 200 of the heating element 196. Tube 268 can include an insulating wrapping, not shown; however, this is not required. Tube 268 can be formed of many different types of materials (e.g., plastic, metal, polymer, etc.). The main heating chamber 270 of heating element 196 can be designed to divide the fluid stream into a plurality of fluid streams; however, this is not required. If has been found that when the fluid streams are divided into two or more fluid streams and that such divided fluid streams are directed to different portions of the main heating chamber, a significantly larger percentage of the fluid flowing through the heating element is fully vaporized, thereby forming a drier steam. In many prior art steamers, only about 50-80 percent of the fluid passing through the heating element is fully vaporized. As such a wet steam is produced and also some non-vaporized fluid is expelled from the steamer. As such, these types of steamers cannot be used to clean upholstery or other types of fabrics due to the high liquid content of the wet steam. The heating element of the present invention is designed to vaporize over 80 percent of the fluid such as water that passes through the heating element when the heating element is ready for use. In one non-limiting configuration, the heating element of the present invention vaporizes at least 85 percent of the fluid such as water that passes through the heating element when the heating element is ready for use. In another non-limiting configuration, the heating element of the present invention vaporizes at least 90 percent of the fluid such as water that passes through the heating element when the heating element is ready for use. In another non-limiting configuration, the heating element of the present invention vaporizes at least 95 percent of the fluid such as water that passes through the heating element when the heating element is ready for use. In another non-limiting configuration, the heating element of the present invention vaporizes 95-100 percent of the fluid such as water that passes through the heating element when the heating element is ready for use.

Figure 14:
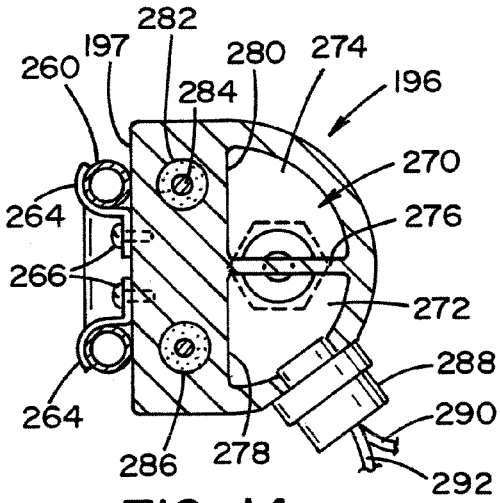
FIG. 14 is a cross-sectional view along line 14-14 of FIG. 11.
Figure 15:
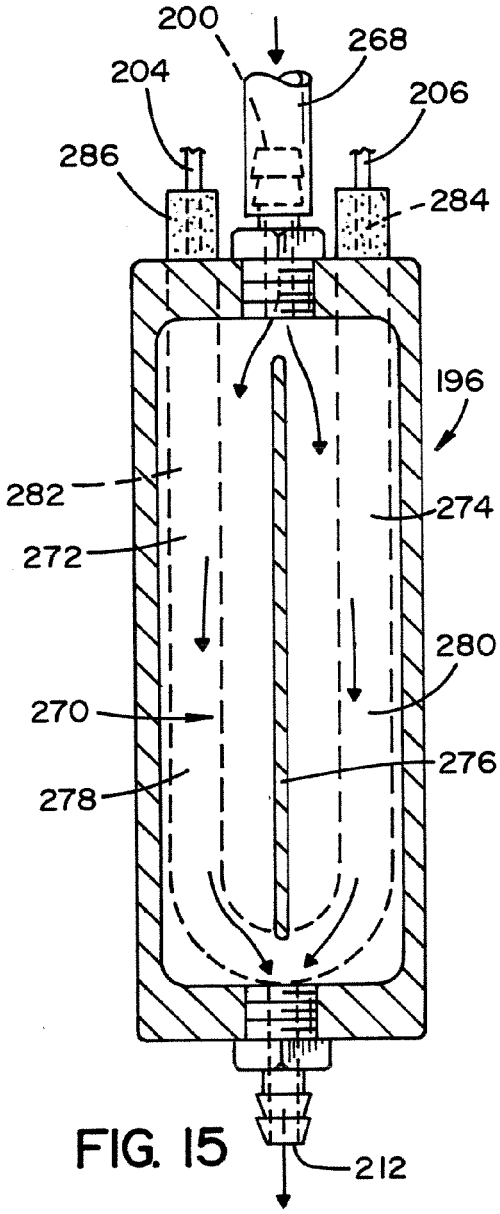
FIG. 15 is a cross-sectional view along line 15-15 of FIG. 11.

Referring again to FIGS. 13-15, a main heating chamber 270 that is divided into two chambers 272, 274 is illustrated. As can be appreciated, the main heating chamber 270 can be divided into more than two chambers. As also can be appreciated, the chamber configuration of the main heating chamber 270 is non-limiting. The two chambers 272, 274 are divided by a dividing wall 274 in the main heating chamber 270. The dividing wall is illustrated as running straight down the middle of the main heating chamber 270; however, it can be appreciated that the dividing wall can have other configurations and/or be located in different regions of the main heating chamber 270. As best illustrated in FIG. 15, when fluid enters the main heating chamber 270 from opening 200, the fluid stream entering the main heating chamber 270 is divided into two smaller streams that pass on both sides of dividing wall 276 as illustrated by the arrows in FIG. 15. As the fluid flows in chambers 272, 274, the fluid contacts the heated bottom surface 278, 280 of the two chambers which results in the vaporization of the fluid in the two chambers. As illustrated in FIGS. 11 and 15, heating plate 282 is positioned below the bottom surfaces 278 and 280 so as to heat the fluid flowing in chambers 272, 274. The heating plate is illustrated as having a U-shape rod; however, other cross-sectional shapes and/or configurations of the heating plate can be used. Only a single heating plate is illustrated; however, it can be appreciated, that more than one heating plate can be used. The heating plate is illustrated as being uniformly positioned below bottom surfaces 278 and 280; however, this is not required. The heating plate is illustrated in FIGS. 13 and 14 to include a heating wire 284. One or more heating wires can be used. The heating wire is illustrated as being encircled by a protective material 286; however, this is not required.

As illustrated in FIG. 2, a fluid tube 198 directs fluid directly into opening 200 of the heating element 196. In this configuration, there is no preheating tube.

The heating element 196 can include insulation, not shown, about the body to protect other components in the steam generator from heat damage; however, this is not required. Likewise, all or a portion of fluid tube 198 can include an insulating cover; however, this is not required. The heating element 196 is illustrated as being connected to the interior of the steam generator by a plurality of screws 202; however, it can be appreciated that other or additional connection arrangements can be used. The heating element 196 can also be at least partially contained within a mounting body or bracket, not shown, to further isolate the heat generated by the heating element from one or more other components within the steam generator; however, this is not required. Two electrical connections 204, 206 are used to supply electricity to the heating wire 284 of the heating plate 282 of the heating element 196. These two electrical connections are connected to a power cord 208 that can be connected to a standard wall outlet. As can be appreciated, electricity from power cord 208 can be used to supply power to one or more other components of the steam generator (e.g., electric pumps, if used, indicator lights, if used; thermostats, if used; fluid level indicators, if used; status and indicator panels or displays, if used; etc); however, this is not required. As also can be appreciated, electrical connections 204, 206 can be connected to an internal power source in the steam generator; however, this is not required. The heating element 196 generally includes a thermostat 288 which is connected by wires 290, 292 to indicator light 210. The indicator light is typically used to indicate when the heating element is heated to some predetermined temperature and is now ready for use. The indicator light can be designed to turn on or turn off when the predetermined temperature of the heating element is obtained. The use of a thermostat and/or an indicator light is optional. As can be appreciated, other or additional indicator lights or other types of indicators can be used on the steam generator to provide information to a user.

After the fluid passes through the heating element, the vaporized fluid exits vapor opening 212 of the heating element and into vapor tube 214. As illustrated in FIG. 15, when the heating element includes more than one chamber for heating fluid, the multiple chambers are designed to converge as illustrated by the arrows so that all of the vaporized fluid exits the heating element at vapor opening 212. As can be appreciated, the heating element can include a plurality of vapor openings; however, this is not required. If the heating element includes more than one vapor opening, a heating element that includes multiple chambers for heating fluid need not have the chambers converge; however, this is not required. The vaporized fluid that passes through vapor tube 214 enters vapor nozzle 216. Vapor tube 214 and vapor nozzle 216 can be a single component or two or more separate components. All or a portion of the vapor tube and/or vapor nozzle can include an insulating covering; however, this is not required. Positioned about the end of vapor nozzle 216 are two seal rings 218. The seal rings are used to form a liquid and/or vapor seal between the end of the vapor nozzle 216 and nozzle cavity 114 of nozzle interface 112 when the vapor nozzle 216 of the steam generator is inserted into the nozzle cavity 114 of nozzle interface 112. As can be appreciated, less than two or more than two seal rings can be used. As also can be appreciated, the use of the seal rings is optional. As can further be appreciated, other or additional sealing arrangements between the vapor nozzle 216 and nozzle cavity 114 can be used. The vapor nozzle 216 is secured to the interior of the steam generator by a nozzle flange 220; however, it can be appreciated that other or additional arrangements can be used to secure the vapor nozzle in the body of the steam generator.

Figure 6:
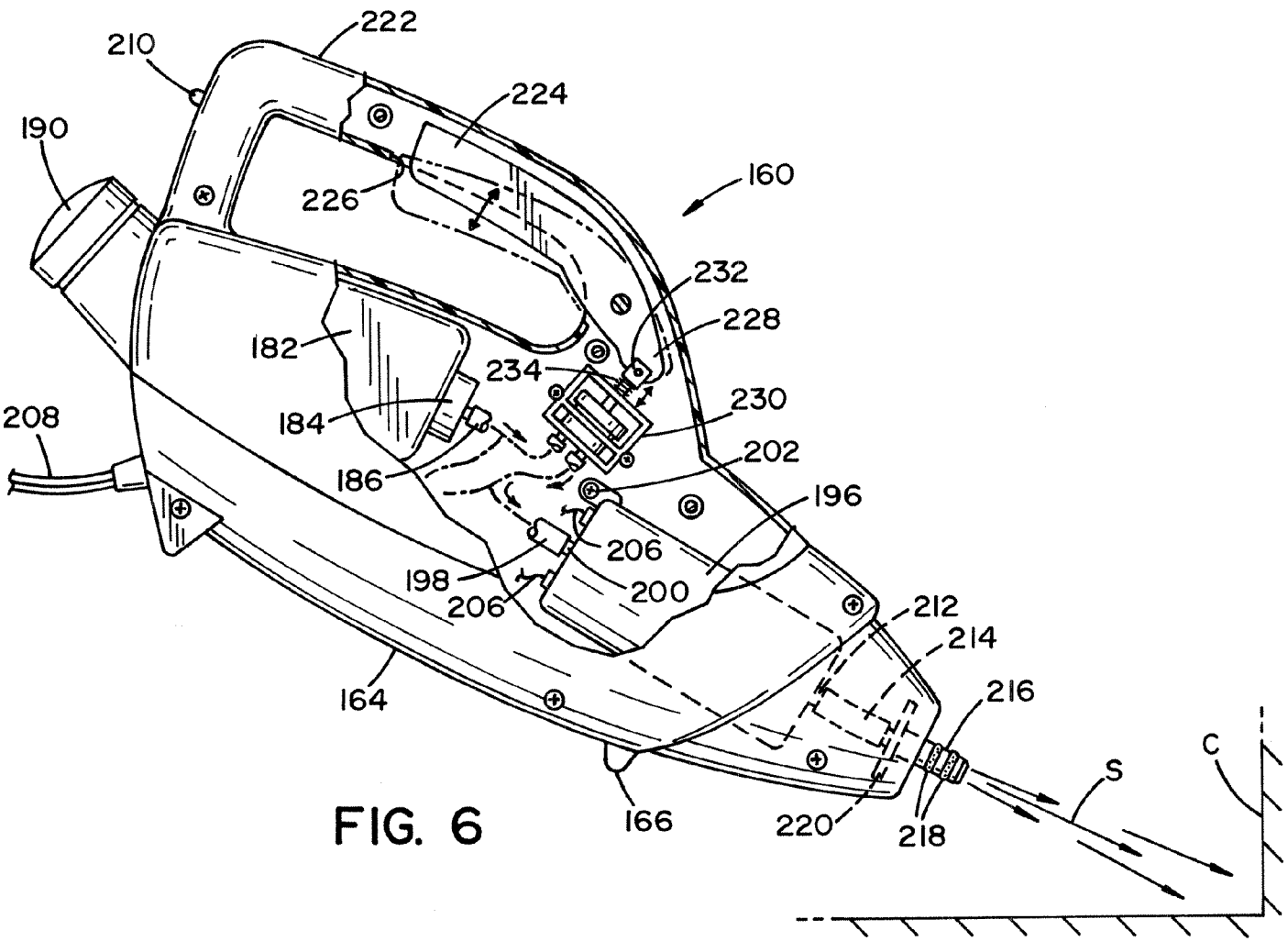
FIG. 6 is a partial sectional view of the steam generator.

As discussed above, the steam generator is designed to be releasably connected to the base mount so that the steam generator can be used as a stand alone hand held steamer. FIG. 5 illustrates how the steam generator can be detached from the base mount of the steam mop. FIGS. 6-10 illustrate the steam generator in the stand alone mode and optional attachments that can be used with the steam generator when used in the stand alone mode. Referring now to FIG. 6, when the steam generator is to be used by a user in the stand alone mode, the steam generator is designed to include a handle 222 that allows the user to grasp a handle so that the steam generator can be conveniently held by a user and the vapor nozzle 216 of the steam generator can be directed to a desired location to be cleaned. The handle 222 also includes a pump lever 224 that is designed to pivot in a handle slot 226 as illustrated by the arrow in FIG. 6. When a user squeezes pump lever 224 at least partially into handle slot 226, the front end 228 pivots downwardly onto pump piston 232 of pump 230. One non-limiting configurations for mounting the handle for pivoting movement is illustrated in FIG. 6; however, it can be appreciated that other configurations for mounting the handle for pivoting movement can be used. Furthermore, it can be appreciated that the handle can be mounted for non-pivoting movement. The movement of the pump piston causes pump 230 to pump fluid from fluid tank 182 to pump 230 and then from pump 230 to heating element 196 as illustrated by the arrows in FIG. 6. A pump spring 234 is positioned between the end of the pump piston and the housing of pump 230 to bias the pump piston in an extended position. As can be appreciated, the pump spring can be designed to bias the pump piston in an unextended position. The use of pump spring 234 is optional. The arrows in FIG. 6 illustrate one non-limiting tubing and pumping configuration to enable fluid such as water to be pumped from the fluid tank 182 to the heating element 196 of the steam generator when the steam generator is in the hand held mode. Pump 230 is illustrated as being a manual pump; however, it can be appreciated that pump 230 can be an electric pump and that handle 224 is used to activate the electric pump; however, this is not required. As illustrated in FIG. 6, a user can direct vapor nozzle 216 toward a desired surface C such as, but not limited to, a counter top so as to steam clean such surface.

Figure 7:
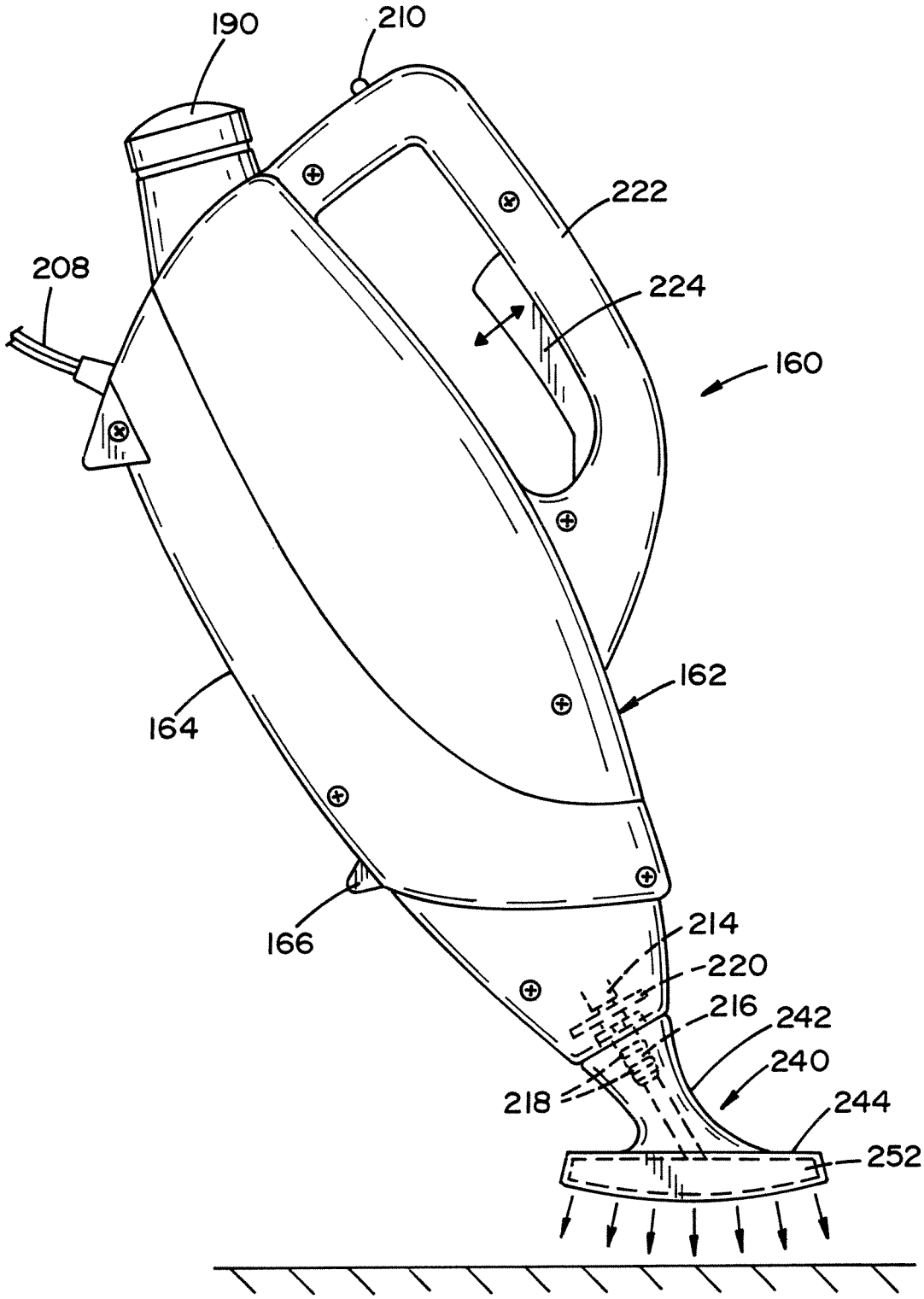
FIG. 7 is a side view of the steam generator having a spray attachment connected to the front end of the steam generator.
Figure 8:
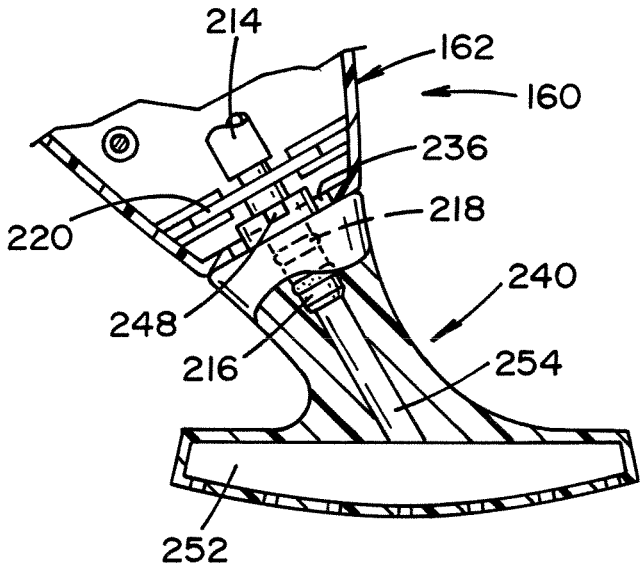
FIG. 8 is an enlarged cross-section of the spray attachment that is connected to the front end of the steam generator.
Figure 9:
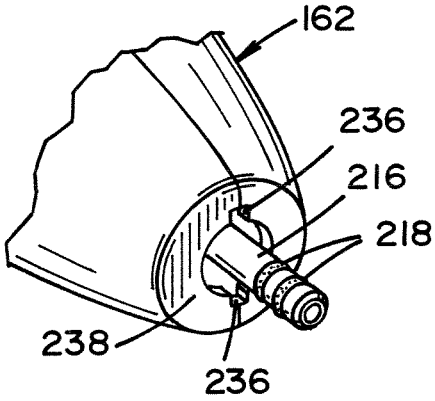
FIG. 9 is an enlarged view of the front end of the steam generator.
Figure 10:
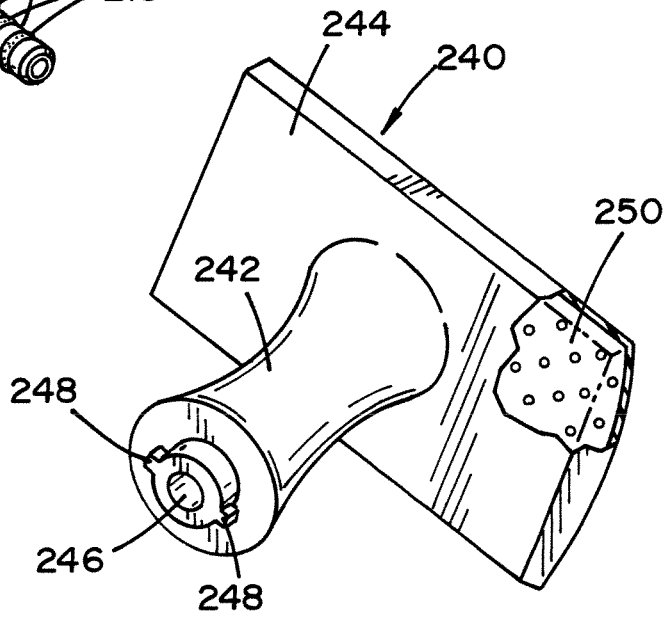
FIG. 10 is a partial sectional view of the spray attachment.

Referring now to FIGS. 7-10, a cleaning attachment 240 can be optionally connected to vapor nozzle 216 when the steam generator is removed from the base mount of the steam mop. As illustrated in FIG. 7, the cleaning attachment includes a neck 242 that is connected to a base 244. The top of the neck 242 includes an opening 246 that is designed to receive a portion of vapor nozzle 216 when the cleaning attachment 240 is connected to the steam generator. A steam passage 254 is positioned between opening 246 and base 244 so that steam can be directed from the opening to the base. The seals 218 on the vapor nozzle 216 can be used to form a liquid or vapor seal between the vapor nozzle 216 and the the cleaning attachment 240. The top of neck 242 also includes two lock flanges 248 that are designed to be inserted into lock slots 236 located at end 238 of body 162 of the steam generator. Once the lock flanges 248 are inserted into lock slots 236, the cleaning attachment 240 is rotated to secure the cleaning attachment 240 to the body 162 of the steam generator. The cleaning attachment 240 can be simply removed from the body 162 of the steam generator by rotating the cleaning attachment 240 in an opposite direction and then pulling the cleaning attachment 240 off the end 238 of body 162 of the steam generator. The base 244 of the cleaning attachment 240 can include a sponge or absorbent material 250 that is located in a base cavity 252; however, this is not required. The base of the cleaning attachment can include a plurality of holes 256 to allow steam to exit the base; however, this is not required. As illustrated in FIG. 7, when the cleaning attachment 240 is connected to the steam generator, the cleaning attachment 240 can function as a small mop to steam clean small areas. As can be appreciated, the cleaning attachment 240 can have other or additional uses (e.g. press fabrics, clean curtains, clean rugs, clean upholstery, etc.).

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

We claim:

1. A steam mop comprising a handle, an extension member, a base mount, a steam generator, and a mop head, said steam generator including a body that at least partially contains a fluid tank, fluid pump and a heating element used to at least partially vaporize fluid, said body releasably connected to said base mount such that said steam generator can be used as a steam producing device for the steam mop or can be disconnected from said base mount and be used as a stand alone steam producing device, said steam generator includes two pump actuators, a first pump actuator being positioned on said body of said steam generator to engage a component on said base mount, extension member or combinations thereof when said steam generator is connected to said base mount such that a user can cause said first pump actuator to actuate said fluid pump during use of the steam mop, said second pump actuator positioned on said body of said steam generator and spaced from said first pump actuator, said second pump actuator enabling a user to actuate said fluid pump when said steam generator is disconnected from said base mount, said steam generator includes two fluid pumps at least partially contained in said body of said steam generator, said first fluid pump designed to be actuated by said first pump actuator, said second fluid pump designed to be actuated by said second pump actuator.

2. The steam mop as defined in claim 1, wherein said handle is connected to a first end of said extension member and said base mount is connected to said second end of said extension member, said second end of said extension member at least partially positioned in a tube cavity of said base mount, said second end of said extension member mounted to said base mount such that said second end is longitudinally moveable within said tube cavity, said longitudinal movement of said second end of said extension member said tube cavity causing actuation of said water pump in said steam generator thereby causing fluid in said fluid tank to flow to said heating element.

3. The steam mop as defined in claim 1, wherein said base mount includes a nozzle interface to be releasably connected to a nozzle on a front end of said steam generator when said steam generator is connected to said base mount.

4. The steam mop as defined in claim 3, wherein said nozzle, said nozzle interface, or combinations thereof include a sealing arrangement to form a liquid seal, a vapor seal, or combinations thereof between said nozzle and said nozzle interface when said steam generator is connected to said base mount.

5. The steam mop as defined in claim 1, wherein said second pump actuator is positioned on a handle of said body of said steam generator.

6. The steam mop as defined in claim 1, including at least one steam sprayer connected to or interconnected to said base mount, said at least one steam sprayer positioned to direct steam that passes through said at least one sprayer at least partially forwardly of said mop head when said mop head is positioned on a floor surface.

7. The steam mop as defined in claim 6, including a plurality of sprayers connected to or interconnected to said base mount, a plurality of said sprayers positioned to direct steam that passes through said sprayers at least partially forwardly of said mop head when said mop head is positioned on a floor surface.

8. The steam mop as defined in claim 1, wherein said base mount includes a latch arrangement designed to releasably engage said body of said steam generator.

9. The steam mop as defined in claim 1, wherein said heating element includes a fluid preheating element connected or interconnected to a body of said heating element, said preheating element designed to preheat fluid to a temperature below a vaporization temperature of said fluid prior to said fluid being feed into said body of said heating element.

10. The steam mop as defined in claim 1, wherein said heating element includes a fluid feed splitter that creates a plurality of fluid steams that are feed to a heating chamber in said heating element, said heating chamber designed to vaporize fluid in said heating chamber.

11. The steam mop as defined in claim 10, wherein at least two of said fluid steams deposited in different locations within said heating chamber.

12. The steam mop as defined in claim 1, wherein said mop head includes a removable cleaning pad.

13. The steam mop as defined in claim 1, including a cleaning attachment designed to connect to a nozzle on a front end of said steam generator when said steam generator is disconnected to said base mount, said cleaning attachment including a neck and a base, said neck designed to be releasably connected to said nozzle of said steam generator.

14. A steam mop comprising a handle, an extension member, a base mount, a steam generator, and a mop head, said steam generator including a body that at least partially contains a fluid tank, fluid pump and a heating element used to at least partially vaporize fluid, said body connected to said base mount such that said steam generator can be used as a steam producing device for the steam mop, said handle being connected to a first end of said extension member and said base mount being connected to said second end of said extension member, said second end of said extension member at least partially positioned in a tube cavity of said base mount, said second end of said extension member mounted to said base mount such that said second end is longitudinally moveable within said tube cavity, said longitudinal movement of said second end of said extension member of said tube cavity causing actuation of said water pump in said steam generator thereby causing fluid in said fluid tank to flow to said heating element, said steam generator includes two fluid pumps at least partially contained in said body of said steam generator,. said first fluid pump designed to be actuated by said first pump actuator, said second fluid pump designed to be actuated by said second pump actuator.

15. The steam mop as defined in claim 14, including at least one steam sprayer connected to or interconnected to said base mount, said at least one steam sprayer positioned to direct steam that passes through said at least one sprayer at least partially forwardly of said mop head when said mop head is positioned on a floor surface.

16. The steam mop as defined in claim 15, including a plurality of sprayers connected to or interconnected to said base mount, a plurality of said sprayers positioned to direct steam that passes through said sprayers at least partially forwardly of said mop head when said mop head is positioned on a floor surface.

17. The steam mop as defined in claim 14, wherein said heating element includes a fluid preheating element connected or interconnected to a body of said heating element, said preheating element designed to preheat fluid to a temperature below a vaporization temperature of said fluid prior to said fluid being fed into said body of said heating element.

18. The steam mop as defined in claim 14, wherein said heating element includes a fluid feed splitter that creates a plurality of fluid steams that are feed to a heating chamber in said heating element, said heating chamber designed to vaporize fluid in said heating chamber.

19. The steam mop as defined in claim 18, wherein at least two of said fluid steams deposited in different locations within said heating chamber.

20. A steam mop comprising a handle, an extension member, a base mount, a steam generator, a mop head, and at least one steam sprayer, said steam generator including a body that at least partially contains a fluid tank, fluid pump and a heating element used to at least partially vaporize fluid, said body connected to said base mount such that said steam generator can be used as a steam producing device for the steam mop, said at least one steam sprayer connected to or interconnected to said base mount, said at least one steam sprayer positioned to direct steam that passes through said at least one sprayer at least partially forwardly of said mop head when said mop head is positioned on a floor surface, said steam generator includes two fluid pumps at least partially contained in said body of said steam generator, said first fluid pump designed to be actuated by said first pump actuator, said second fluid pump designed to be actuated by said second pump actuator.

21. The steam mop as defined in claim 20, including a plurality of sprayers connected to or interconnected to said base mount, a plurality of said sprayers positioned to direct steam that passes through said sprayers at least partially forwardly of said mop head when said mop head is positioned on a floor surface.

22. The steam mop as defined in claim 20, wherein said handle is connected to a first end of said extension member and said base mount is connected to said second end of said extension member, said second end of said extension member at least partially positioned in a tube cavity of said base mount, said second end of said extension member mounted to said base mount such that said second end is longitudinally moveable within said tube cavity, said longitudinal movement of said second end of said extension member said tube cavity causing actuation of said water pump in said steam generator thereby causing fluid in said fluid tank to flow to said heating element.

23. The steam mop as defined in claim 20, wherein said heating element includes a fluid preheating element connected or interconnected to a body of said heating element, said preheating element designed to preheat fluid to a temperature below a vaporization temperature of said fluid prior to said fluid being feed into said body of said heating element.

24. The steam mop as defined in claim 20, wherein said heating element includes a fluid feed splitter that creates a plurality of fluid steams that are fed to a heating chamber in said heating element, said heating chamber designed to vaporize fluid in said heating chamber.

25. The steam mop as defined in claim 24, wherein at least two of said fluid steams deposited in different locations within said heating chamber.

26. A steam mop comprising a handle, an extension member, a base mount, a steam generator, and a mop head, said steam generator including a body that at least partially contains a fluid tank, fluid pump and a heating element used to at least partially vaporize fluid, said body connected to said base mount such that said steam generator can be used as a steam producing device for the steam mop, said heating element including i) a fluid preheating element connected or interconnected to a body of said heating element, ii) a fluid feed splitter that creates a plurality of fluid steams that are fed to a heating chamber in said heating element, or combinations thereof, said heating chamber designed to vaporize fluid in said heating chamber, said preheating element designed to preheat fluid to a temperature below a vaporization temperature of said fluid prior to said fluid being fed into said body of said heating element, said steam generator includes two fluid pumps at least partially contained in said body of said steam generator, said first fluid pump designed to be actuated by said first pump actuator, said second fluid pump designed to be actuated by said second pump actuator.

27. The steam mop as defined in claim 26, wherein at least two of said fluid steams deposited in different locations within said heating chamber.

28. The steam mop as defined in claim 26, wherein said handle is connected to a first end of said extension member and said base mount is connected to said second end of said extension member, said second end of said extension member at least partially positioned in a tube cavity of said base mount, said second end of said extension member mounted to said base mount such that said second end is longitudinally moveable within said tube cavity, said longitudinal movement of said second end of said extension member said tube cavity causing actuation of said water pump in said steam generator thereby causing fluid in said fluid tank to flow to said heating element.

29. The steam mop as defined in claim 26, including at least one steam sprayer connected to or interconnected to said base mount, said at least one steam sprayer positioned to direct steam that passes through said at least one sprayer at least partially forwardly of said mop head when said mop head is positioned on a floor surface.

30. The steam mop as defined in claim 29, including a plurality of sprayers connected to or interconnected to said base mount, a plurality of said sprayers positioned to direct steam that passes through said sprayers at least partially forwardly of said mop head when said mop head is positioned on a floor surface.

31. The steam mop as defined in claim 26, wherein said body of said steam generator is releasably connected to said base mount such that said steam generator can be used as a steam producing device for the steam mop or can be disconnected from said base mount and be used as a stand alone steam producing device.

32. The steam mop as defined in claim 31, wherein said base mount includes a nozzle interface to be releasably connected to a nozzle on a front end of said steam generator when said steam generator is connected to said base mount.

33. The steam mop as defined in claim 32, wherein said nozzle, said nozzle interface, or combinations thereof include a sealing arrangement to form a liquid seal, a vapor seal, or combinations thereof between said nozzle and said nozzle interface when said steam generator is connected to said base mount.

34. The steam mop as defined in claim 31, wherein said steam generator includes two pump actuators, a first pump actuator being positioned on said body of said steam generator to engage a component on said base mount, extension member or combinations thereof when said steam generator is connected to said base mount such that a user can cause said first pump actuator to actuate said fluid pump during use of the steam mop, said second pump actuator positioned on said body of said steam generator and spaced from said first pump actuator, said second enabling a user to actuate said fluid pump when said steam generator is disconnected from said base mount.

35. The steam mop as defined in claim 34, wherein said second pump actuator is positioned on a handle of said body of said steam generator.

36. The steam mop as defined in claim 31, wherein said base mount includes a latch arrangement designed to releasably engage said body of said steam generator.

* * * * *